US007040309B2

(12) United States Patent
Johndreau et al.

(10) Patent No.: US 7,040,309 B2
(45) Date of Patent: May 9, 2006

(54) AXLE HOUSING FOR A SUPPORT STAND FOR AN AUTOMATIC BALL THROWING DEVICE

(76) Inventors: Steven S. Johndreau, 5825 Devon Dr., Rocklin, CA (US) 95675; David E. Johndreau, 7022 Daisy La., Citrus Heights, CA (US) 95621

( * ) Notice: Subject to any disclaimer, the term of this patent is extended or adjusted under 35 U.S.C. 154(b) by 0 days.

(21) Appl. No.: 11/083,733

(22) Filed: Mar. 18, 2005

(65) Prior Publication Data

US 2005/0161034 A1 Jul. 28, 2005

Related U.S. Application Data

(63) Continuation of application No. 10/697,913, filed on Oct. 29, 2003, now Pat. No. 6,880,542, and a continuation of application No. 11/034,342, filed on Jan. 11, 2005.

(51) Int. Cl.
*F41B 4/00* (2006.01)
*B60B 33/00* (2006.01)

(52) U.S. Cl. ..... 124/80; 16/18 R; 16/31 R; 16/40; 124/78

(58) Field of Classification Search ..... 16/18 R, 16/19, 29, 30, 31 R, 31 A, 40, 43; 124/6, 124/78, 80; 248/346.11, 647
See application file for complete search history.

(56) References Cited

U.S. PATENT DOCUMENTS 4,827,564 A * 5/1989 Brown ..... 16/18 R
5,237,721 A * 8/1993 Andrisin, III ..... 16/20
6,092,620 A * 7/2000 Klim ..... 181/151
6,155,936 A * 12/2000 Dorr ..... 473/456
6,488,020 B1 * 12/2002 Rosas-Magallan ..... 124/78

* cited by examiner

*Primary Examiner*—John A. Ricci
(74) *Attorney, Agent, or Firm*—Gross & Associates

(57) ABSTRACT

The present inventions provides a directing device for controlling the orientation of a ball launching device, comprising a first member, a second member pivotally attached to the first member, and a third member disposed substantially parallel to the second member, rotatably connected to the second member and operably configured to receive the ball launching device. The device further includes a first actuator connected to the first and second members and, a second actuator connected to the first and third members. When the first actuator is actuated the second member pivots relative to the first member, and when the second actuator is actuated the third member rotates relative to the second member. This invention also provides an automatic ball throwing device having the directing device of this invention and a method of converting a pitching machine into the same. This invention further provides a hopper for use with the directing device.

26 Claims, 18 Drawing Sheets

AXLE HOUSING FOR A SUPPORT STAND FOR AN AUTOMATIC BALL THROWING DEVICE

CROSS REFERENCE TO RELATED APPLICATION

This application is a continuation application of U.S. application Ser. No. 10/697,913, filed on Oct. 29, 2003 now U.S. Pat. No. 6,880,542, and U.S. Application Ser. No. 11/034,342 filed on Jan. 11, 2005, which are incorporated, in their entirety, herein by reference.

BACKGROUND OF THE INVENTION

1. Field of Invention

The present invention relates to ball throwing devices.

2. Description of Related Art

Coaches and players have used conventional ball throwing devices for years to assist in training for various sports, such as baseball and tennis. A number of such devices are described in for example, U.S. Pat. No. 6,237,583 issued to Ripley et al.; U.S. Pat. No. 5,125,653 issued to Kovács et al., and U.S. Pat. No. 6,026,798 issued to Sanders et al. However, these conventional ball throwing devices have numerous drawbacks and shortcomings.

SUMMARY OF INVENTION

It is an object of the present invention to overcome the drawbacks and shortcomings of conventional ball throwing devices. Particularly, conventional ball throwing devices do not provide an efficient way to adjust the flight direction of a ball thrown by a ball launching device. Prior devices and methods have also failed to provide an efficient method for modifying a conventional ball throwing device, (e.g., pitching machine), into an automatic ball throwing device that can automatically adjust the flight direction of a ball. Further, many conventional devices are limited to a narrow range of ball rotation and/or do not provide for a continuous range of ball rotation through 90 degrees (i.e. from a side spin about a horizontal axis of the ball through 90 degrees to a substantially forward or back spin about a vertical axis of the ball). For example, many conventional devices can be used for advanced baseball pitching practice by providing ball rotation about a horizontal axis. This type of rotation is often not desired for baseball infield practice. By not providing a continuous range of spin options, conventional devices do not provide realistic ball movements.

The present invention provides an automatic ball throwing device that can repeatedly and accurately throw balls to a specific target or zone, throw ground balls, and launch balls through the air to various vertical and horizontal directions. The present invention allows a ball to be automatically thrown through a continuous range of ball (i.e. from a side spin about a horizontal axis of the ball through 90 degrees to a substantially forward or back spin about a vertical axis of the ball). Such a device can be used, among other things, to assist baseball players in improving their defensive and offensive skills.

The present invention is more practical and convenient than conventional ball throwing machines, because the ball throwing device of the present invention can, among other things, be utilized by a single person remote from the machine. That person can be the person practicing or a coach assisting a player. Whereas, conventional devices require an operator to be with the machine in order to control the device and throw balls in addition to the aforementioned player or coach.

Further, an embodiment of the ball throwing device of the present invention allows the device to be easily handled and moved by one person. In this way, a single coach can easily and readily move the device around the field for different applications, such as for batting and defensive practice.

Many conventional devices lack the ability to supply an adequate volume of balls to a ball launching device. For example, many conventional ball hoppers or feeders only supply a dozen or so balls. This is inefficient as a user will need to be constantly refilling the conventional hopper. The present invention provides an efficient means for maintaining an adequate bank of balls to be readily supplied to a ball launching device. This means includes a means for preventing clogging of the balls.

Many conventional pitching machines are limited in their versatility. Particularly the devices are primarily used for batting (offensive) practice. Further, altering the orientation of many conventional pitching machines is often cumbersome and it is difficult to readily attain a desired orientation. The present invention overcomes these deficiencies by providing a ball throwing device that can readily be used for offensive or defensive baseball/softball practice; (it is often desired to be able to throw a ball with not only substantially no-spin, forward spin or backward spin, but also to be able to throw a ball with side spin for defensive practice). Further, the present invention allows the orientation of the device to be readily achieved by providing automatic control of a ball directing device made in accordance with the present invention.

The present invention also provides a method for converting a conventional pitching machine to an automatic ball throwing device of the present invention.

More specifically, the present invention provides a directing device for controlling the orientation of a ball launching device, comprising a first member; a second member pivotally attached to the first member; a third member disposed substantially parallel to the second member, rotatably connected to the second member and operably configured to receive the ball launching device; a first actuator connected to the first and second members; and, a second actuator connected to the first and third members, wherein when the first actuator is actuated the second member pivots relative to the first member, and when the second actuator is actuated the third member rotates relative to the second member.

The present invention further provides an automatic ball throwing device comprising a directing device having a first member, a second member pivotally attached to the first member, a third member disposed substantially parallel to the second member and rotatably connected to the second member, a first actuator connected to the first and second members and a second actuator connected to the first and third members; and, a ball launching device connected to the third member, wherein orientation of the ball launching device is controlled by actuation of the first and second actuators such that when the first actuator is actuated the second member pivots relative to the first member and when the second actuator is actuated the third member rotates relative to the second member.

The present invention also provides a ball hopper, comprising a bin having an opening; a delivery portion having a ball channel, the delivery portion is attachable to a ball launching device; a chute having a first and second end, the first end is in communication with the opening of the bin and the second end is in communication with the ball channel; a ball gate disposed along the length of the chute; and a ball pushing member disposed adjacent the ball channel, wherein activation of the ball gate allows a ball from the bin to travel through the chute into the ball channel of the delivery portion and activation of the ball pushing member moves the ball out of the ball channel to the ball launching device.

A method for making an automatic ball throwing device, comprising: obtaining a pitching machine having a ball launching device and a support stand; removing the ball launching device from the support stand; attaching a directing device to the support stand, wherein the directing device includes a first member attachable to the support stand, a second member pivotally attached to the first member, a third member disposed substantially parallel to the second member and rotatably connected to the second member, a first actuator connected to the first and second members, and a second actuator connected to the first and third members; and attaching the ball launching device to the third member of the directing device.

These and other features and advantages of this invention are described in, or are apparent from, the following detailed description of various exemplary embodiments of the devices and methods according to this invention.

BRIEF DESCRIPTION OF FIGURES

Various exemplary embodiments of this invention will be described in detail, with reference to the following figures, wherein.

DETAILED DESCRIPTION OF INVENTION

Figure 1:
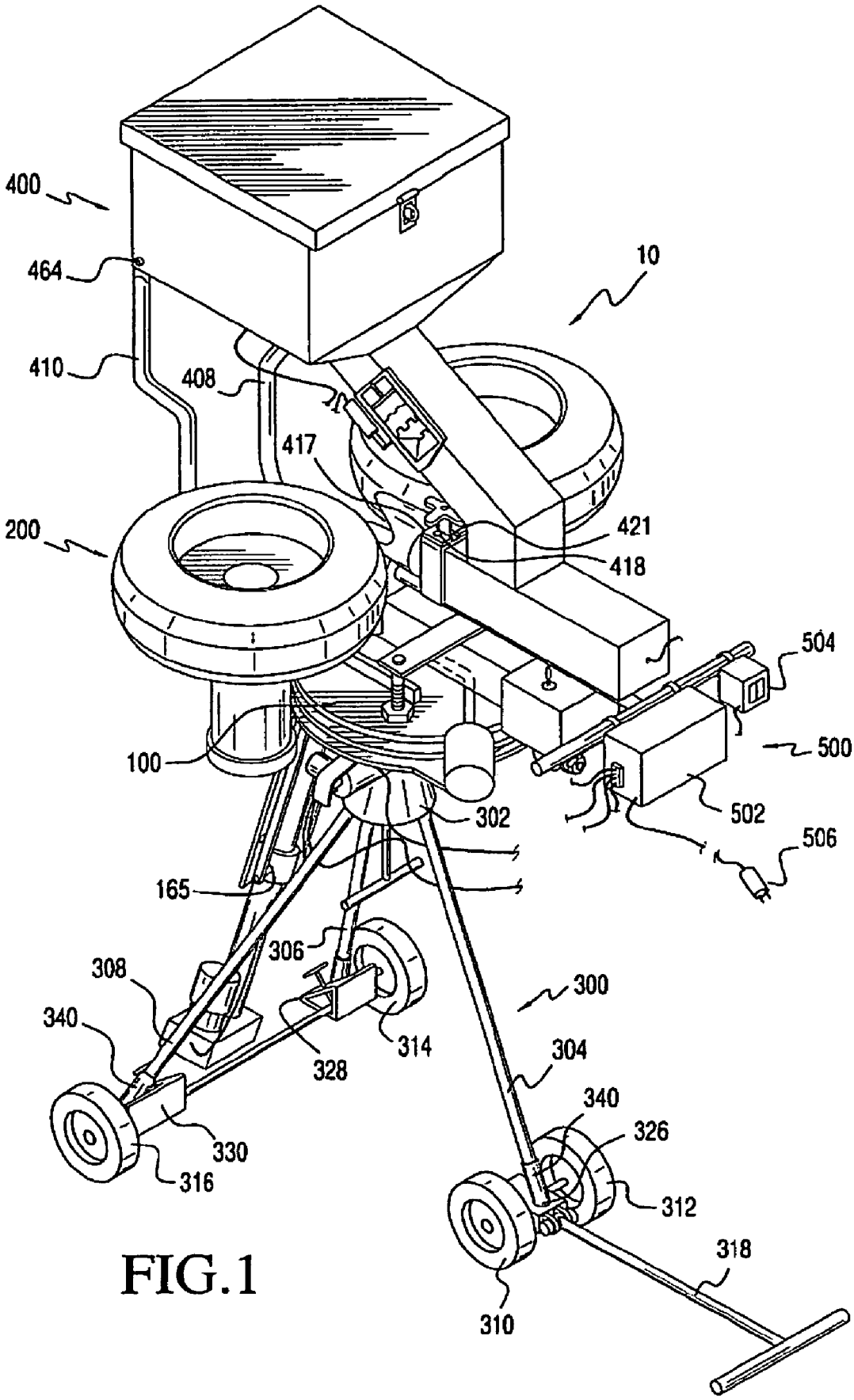
FIG. 1 is a front perspective view of an automatic ball throwing device according to this invention.

FIG. 1 shows an exemplary embodiment of an automatic ball throwing device 10 in accordance with this invention. The automatic ball throwing device 10 includes a ball directing device 100, a ball launching device 200, a support stand 300, a ball hopper 400, and a controller 500. It should be appreciated that the ball hopper 400 is optional.

The ball directing device 100 is attached to the support stand 300. The ball launching device 200 is attached to the ball directing device 100. The ball directing device 100 is operably configured to orient (i.e. rotate and/or pitch) the ball launching device 200, as will be described further below. The controller 500 is electrically connected to the ball directing device 100 and controls the aforementioned rotation and pitch of the ball launching device 200. The ball hopper 400 is attached to the ball directing device 100 and the ball launching device 200. The hopper 400 is configured to retain balls and to provide a conduit to guide balls within the hopper 400 to the ball launching device 200. The controller 500 is electrically connected to the hopper 400 and controls the delivery of balls from the hopper 400 to the ball launching device 200.

Controller 500 includes a power box 502 and a switching device 504. The controller includes a power cord 506. The power cord 506 plugs into a conventional power supply source. The power box 102 provides the electrical power from the power supply to the various components of the device 10. The switching device 504 is electrically connected to the power box 502. The switching device is operably configured to control the electrical signals to the various electrical components of the device 10, as will be described further below. It should be appreciated that the switching device 504 may communicate with the power box 502 via a direct communication link, a radio frequency (i.e. remote control), infa-red, or any other now-known or later developed communication link.

Figure 2:
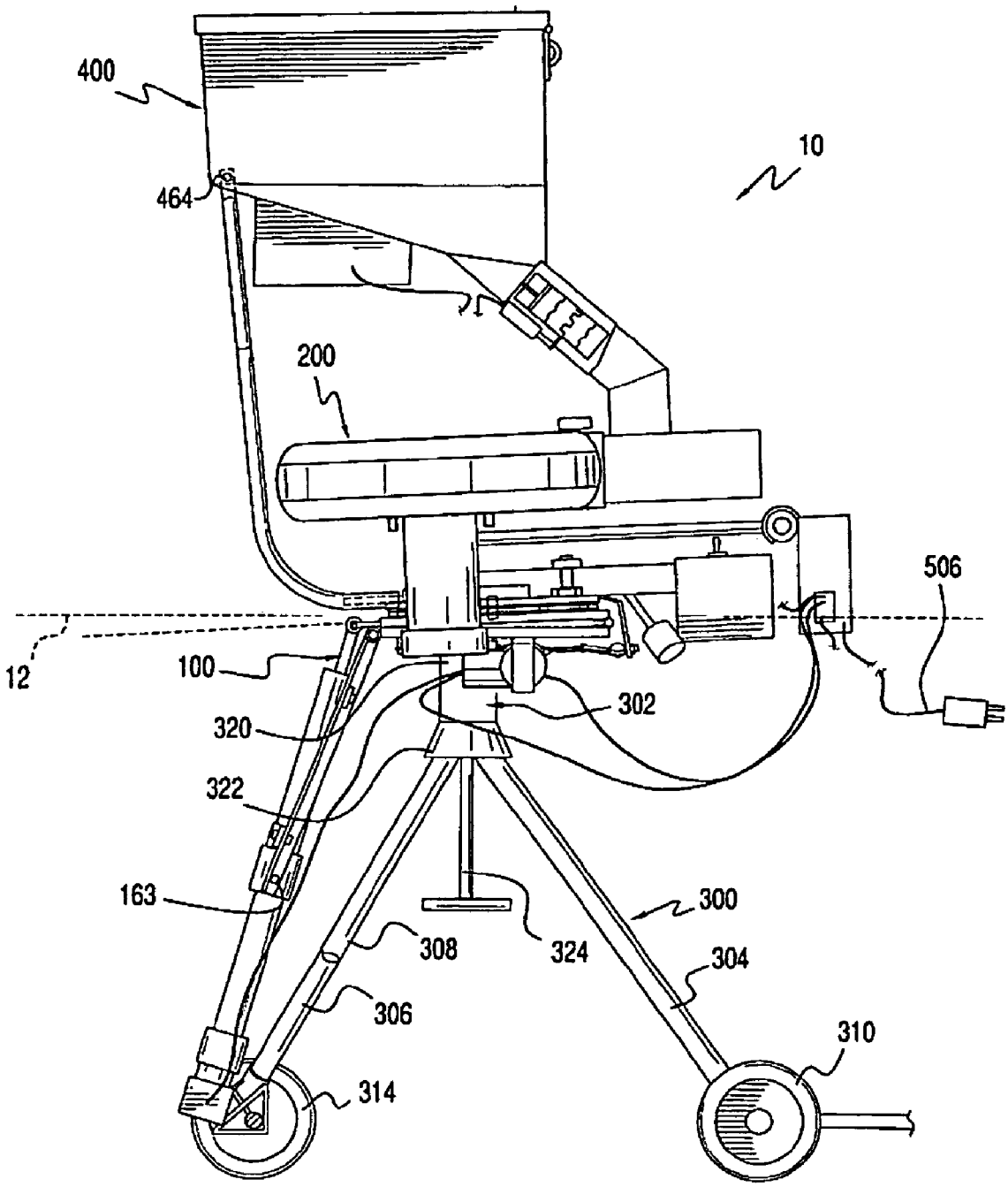
FIG. 2 is a side view of the automatic ball throwing device of FIG. 1 shown in a different operational position.

FIG. 2 shows the device 10 with the ball launching device 200 slightly pitched down relative to a horizontal plane 12, which is parallel to a surface, not shown, on which the device 10 is resting. The relative pitch position of the ball launching device 200, as shown in FIG. 2, is purely an example of one of the many relative pitch positions or attitudes that may be obtained with the present invention. With the particular pitch attitude shown in FIG. 2, the device 10 would, at the user's selective option, eject a ball directed toward the surface or ground, i.e., a ground ball.

Figure 3:
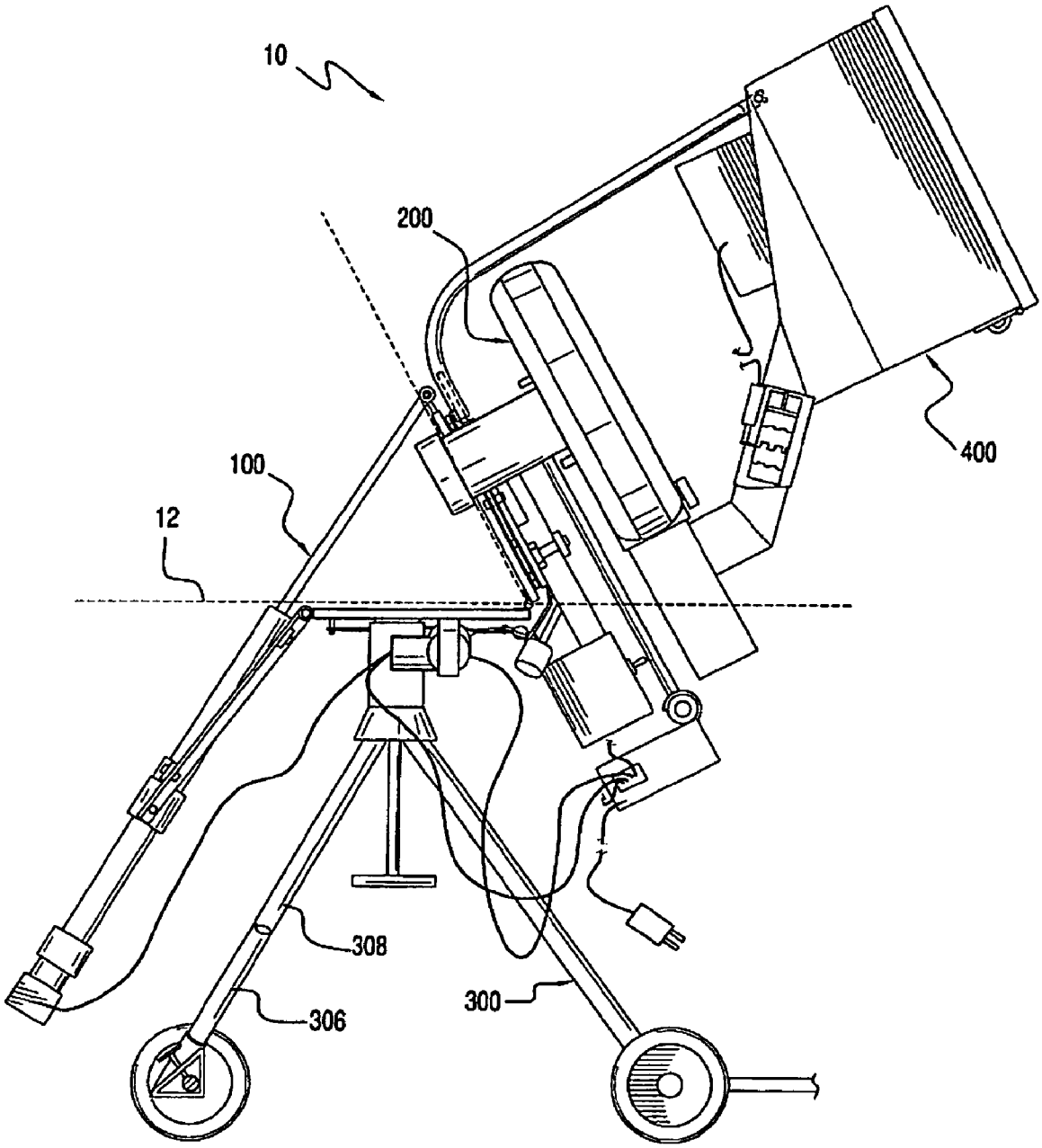
FIG. 3 is another side view similar to FIG. 2, wherein the device is shown in a different operational position.

FIG. 3 shows the device 10 with a different exemplary pitch attitude. Particularly, the ball launching device 200 is pitched up relative to the horizontal plane 12. With this pitch attitude, the device 10 would, at the user's selective option, eject a ball directed into the air at an angle away from the surface or ground, i.e., a fly ball.

Figure 4:
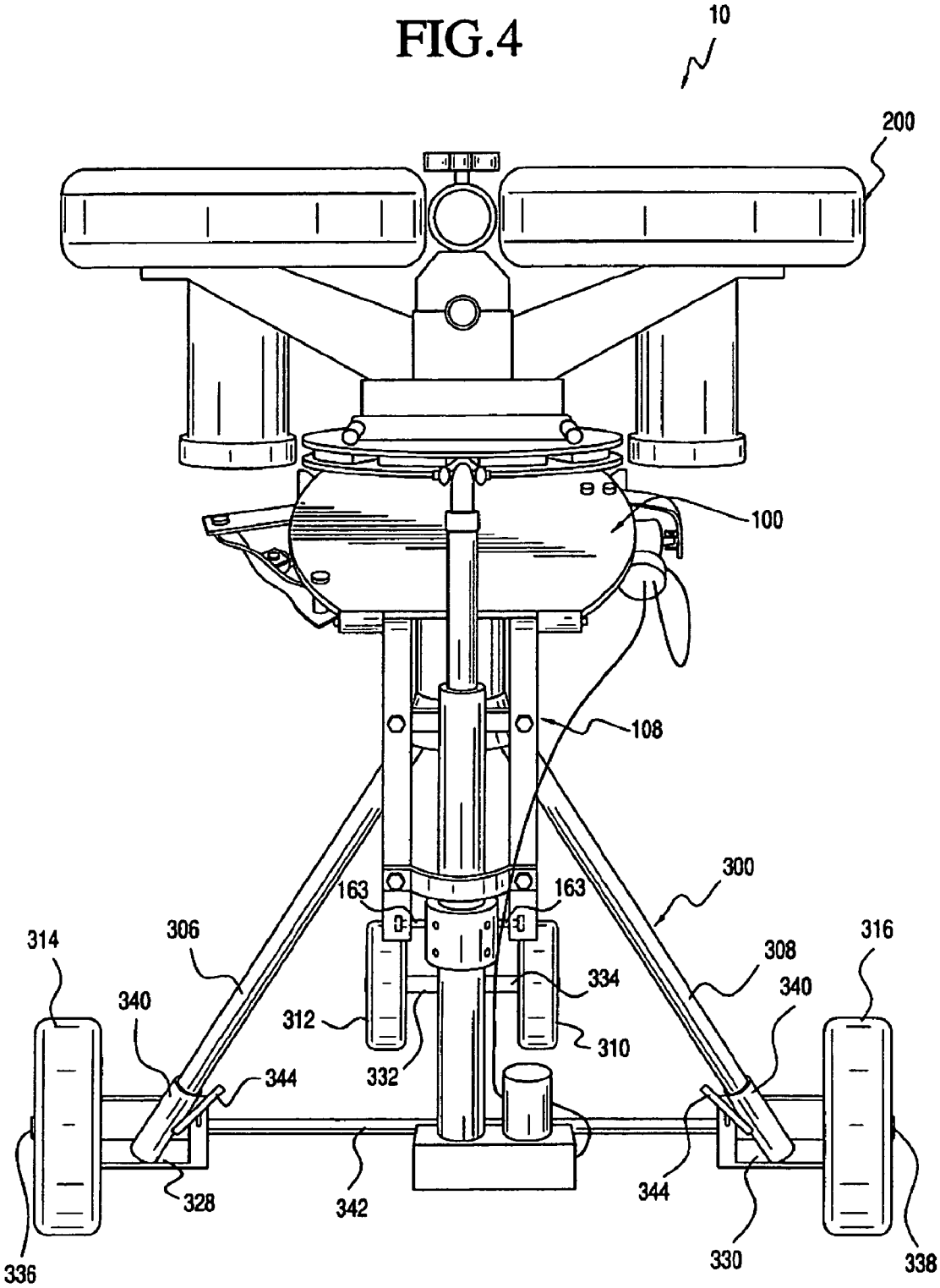
FIG. 4 is another front perspective view of the automatic ball throwing device of FIG. 1, shown in another operational position.
Figure 5:
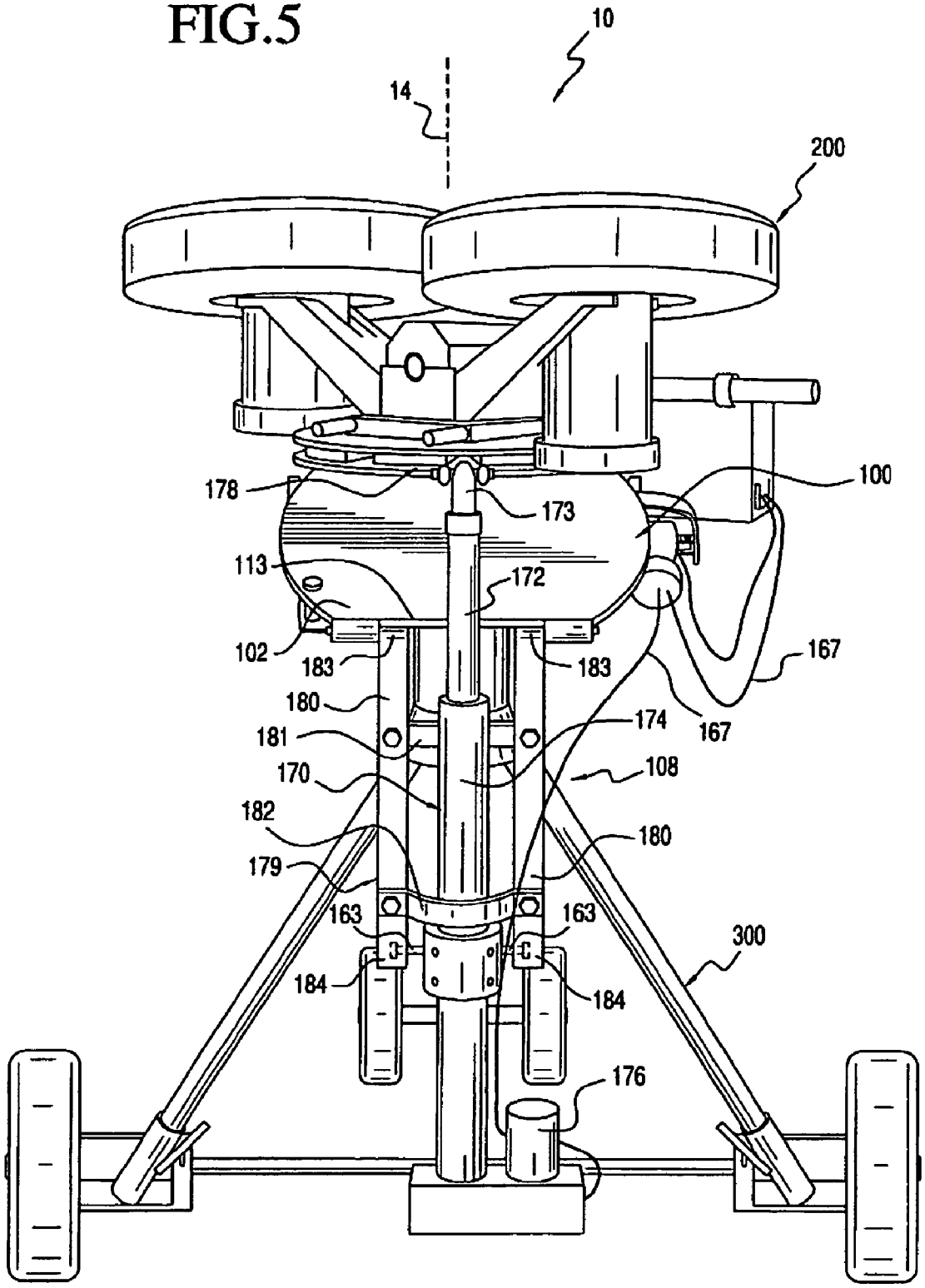
FIG. 5 is another front perspective view of the automatic ball throwing device of FIG. 1, shown in yet another operational position.

FIGS. 4 and 5 show a front perspective view of the device 10. The hopper 400 is not shown in FIGS. 4 and 5 for purposes of clarity. FIG. 4 shows the ball launching device 200 slightly pitched up relative to the horizontal plane 12, not shown in FIG. 4. FIG. 5 shows the ball launching device 200 slightly pitched up relative to the horizontal plane 12, similar to the pitch attitude shown in FIG. 4, and slightly rotated about a central axis 14 of the device 10. If, for example, the device 10, with the pitch and rotational attitude displayed in FIG. 5, was placed at or near home plate on a baseball diamond, the device would throw a line-drive or a fly ball towards the right side of the field with the pitch and rotational attitude displayed in FIG. 5.

Figure 6:
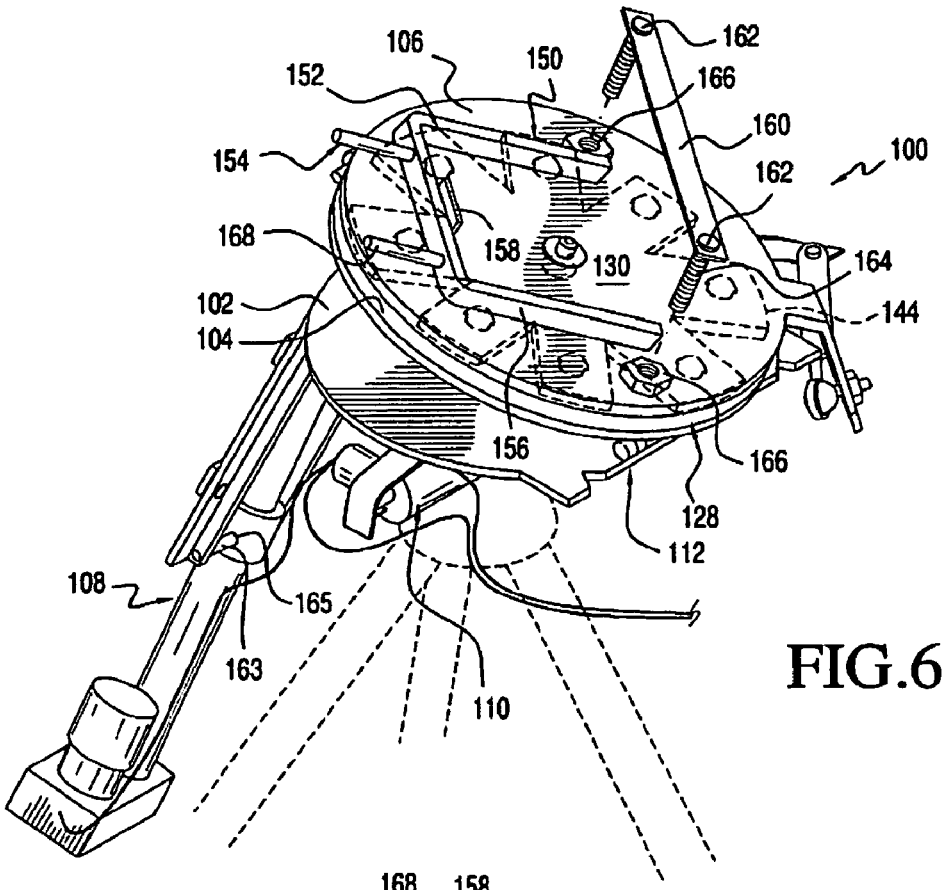
FIG. 6 is a side perspective view of a ball directing device according to the present invention.
Figure 7:
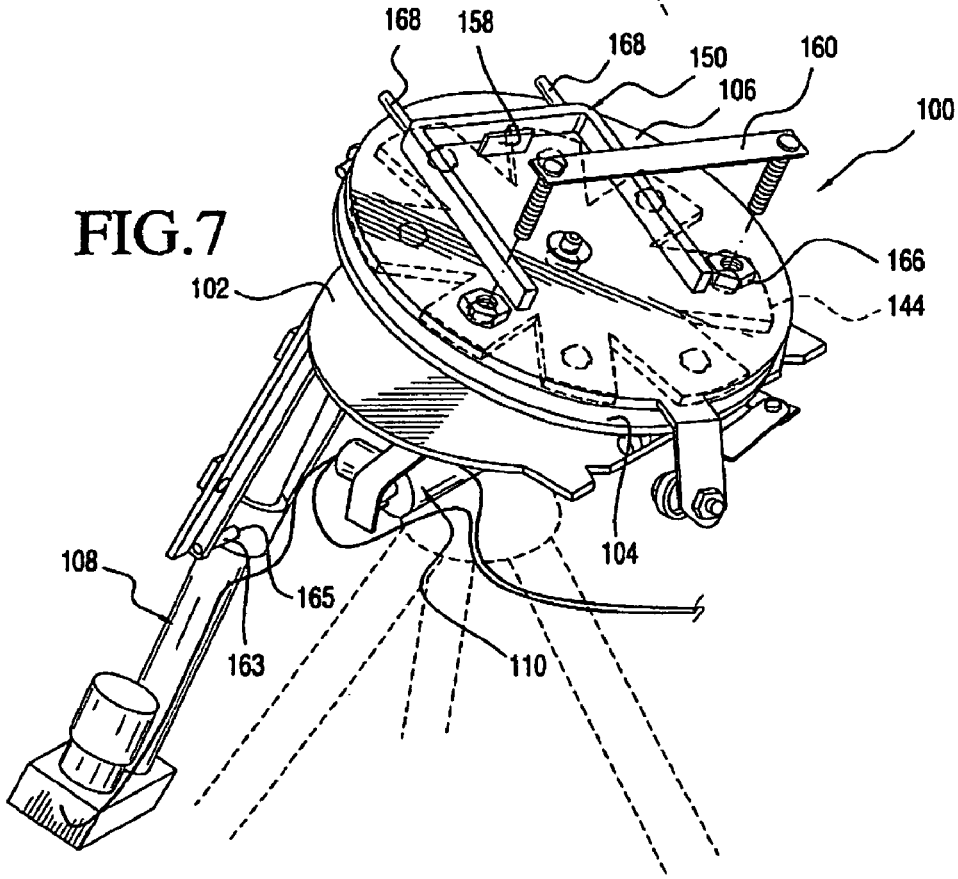
FIG. 7 is another side perspective view of the ball directing device of FIG. 6, shown in another operational position.

FIGS. 6 and 7 show a top perspective view of the ball directing device 100. The ball directing device 100 allows the user to selectively orient the ball launching device 200. The ball directing device 100 includes a support member 102, a tilt member 104, a rotatable member 106, a first actuator assembly 108 and a second actuator assembly 110.

In this exemplary embodiment, the support member 102 has generally a plate-like shape. It is preferred that a rear portion 112 of the support member 102 include a substantially straight edge. It is further preferred that the sides of the support member 102 are rounded, but a front portion 113 (shown in FIG. 8) includes a straight edge. It should be appreciated that the support member 102 could be made in any number of shapes, depending on the manufacturers design choice. For example, the support member could be the shape of an ellipse, a rectangle or a square, etc.

Figure 8:
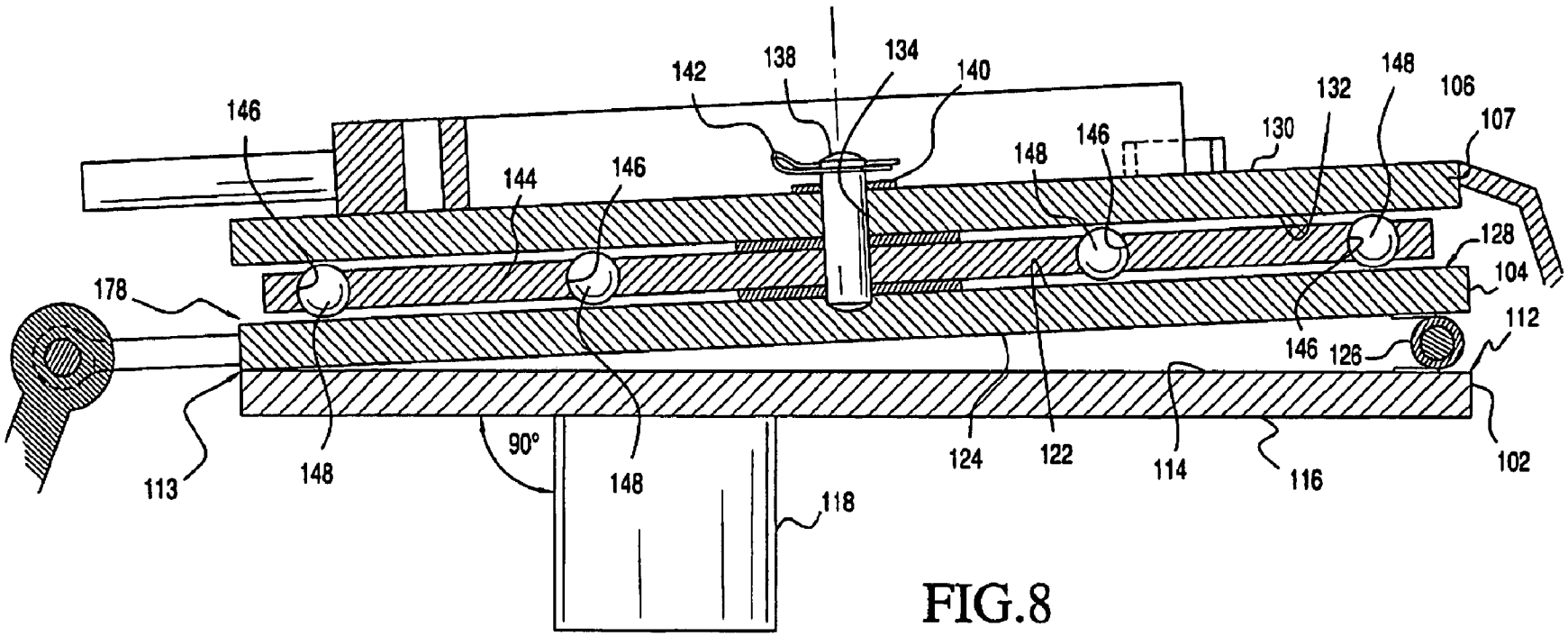
FIG. 8 is a cross-sectional view of a portion of the ball directing device of FIG. 6.

FIG. 8 is a cross-sectional view of a portion of the ball directing device 100. As seen in this Figure, the support member 102 has a top side 114 and a bottom side 116. The support member 102 includes an attachment member 118. The attachment member 118 is disposed on the bottom side 116 of the support member 102. In this embodiment, the attachment member 118 is a shaft. The attachment member 118 is operably configured to attach to the support stand 300, (not shown in FIG. 8), as will be described further below. It should be appreciated that the attachment member can be any of a number of forms other than a shaft so long as it provides for attachment to the support stand 300.

The attachment member 118 is preferred to be extended from the bottom surface 116 of the support member 102 at 90°. However, it should be appreciated that in other exemplary embodiments, the angle can be any desired angle for the particular application.

Figure 9:
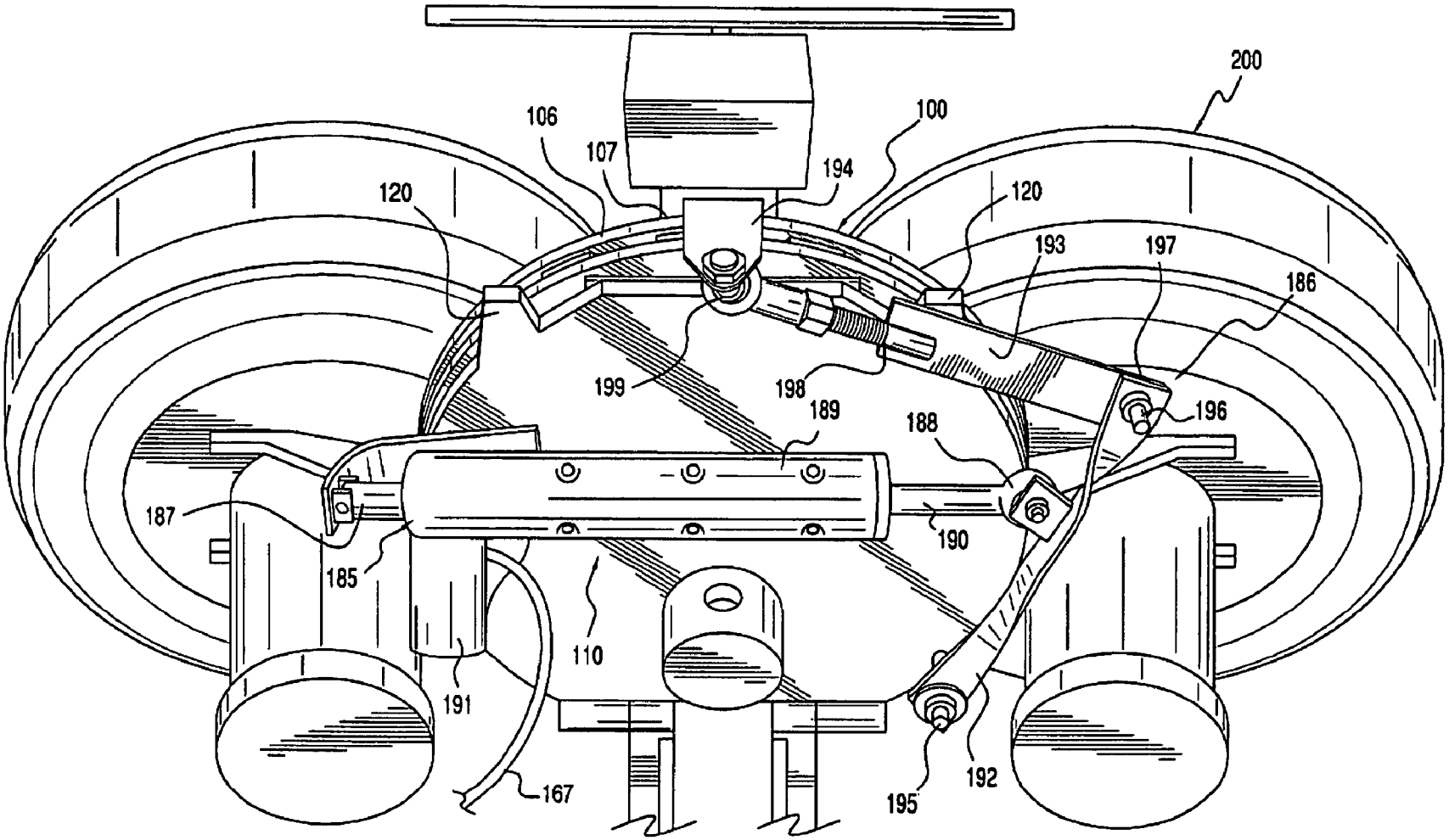
FIG. 9 is a front perspective view of a portion of the ball directing device of FIG. 6, shown with a ball launching device.
Figure 10:
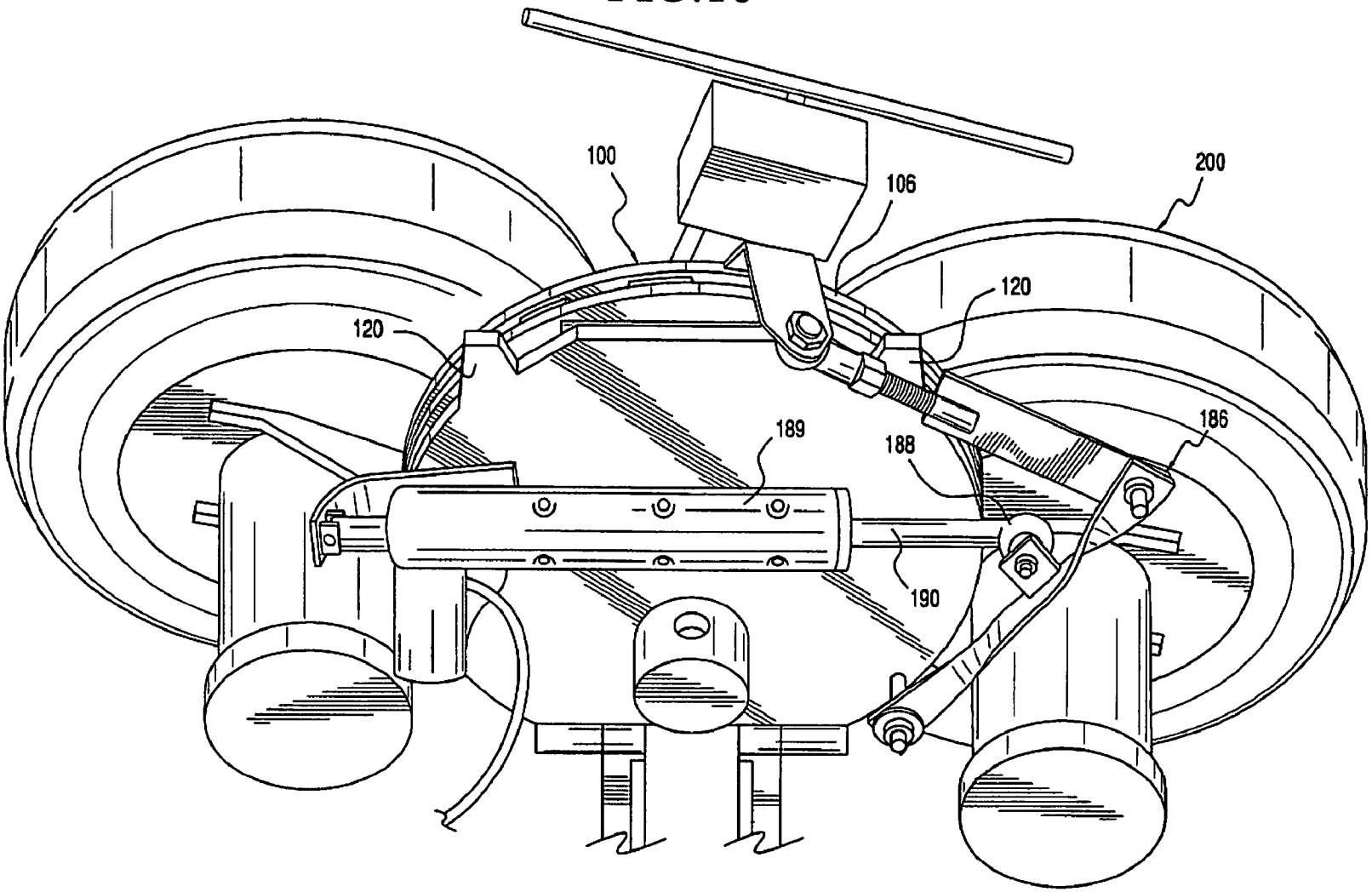
FIG. 10 is another front perspective view of a portion of the ball directing device of FIG. 6, shown in another operational position with a ball launching device.

FIGS. 9 and 10, display a bottom rear perspective of a portion of the ball directing device 100 and the ball launching device 200. For purposes of clarity, the controller 500 is not shown in the FIGS. 9 and 10. In FIG. 9, the ball directing device 200 is positioned such that the ball launching device 200 is facing directly toward the front of the device 10. In FIG. 10, the rotatable member 106 of the ball directing device 100 is shown rotated such that the ball launching device 200 is facing toward the front left of the device 10. As shown in FIGS. 9 and 10, the support member 102 further includes stops (protrusions) 120. The stops 120 extend from the support member 102. Preferably, the stops are in substantially the same plane as the support member 102. The stops 120 are adapted to limit the rotation of the rotatable member 106. Particularly, as will be discussed further below, the rotatable member 106 is prohibited from further rotation when an attachment member 194 comes into contact with either of the stops 120. In this embodiment, the stops 120 are disposed along the rear portion 112 of the outer periphery of the support member 102. Preferably, the protrusions are disposed apart to provide at least 110 degrees of rotational movement of the rotatable member 106. 110 degrees will enable a user to utilize an entire baseball field including foul territory. It should be appreciated that the stops could be arranged in a different position on the periphery on other embodiments to change the degrees of freedom. It should also be appreciated that the stops 120 are optional.

Referring again to FIGS. 6, 7, 8 and 9, the tilt member 104 is shown having generally a plate-like shape. It should be appreciated that the tilt member 104 could be made in any number of shapes. For example, it could be a box-like member or have a generally rectangular shape. In addition, it should be appreciated that in other embodiments the shape of the tilt member 104 may be different than the shape of the support member 102.

The tilt member 104 has a top side 122 and a bottom side 124. The tilt member 104 is pivotally attached to the support member 102. Preferably, the bottom side 124 is attached via a link member 126, to the top side 114 of the support member 102. It is preferred that the link member 126 be at least one hinge. It should be appreciated that any link member allowing angular movement of the tilt member through about 70–95°, preferably 75–95°, more preferably through about 80–90°, and most preferably through 90° relative to the support member would be sufficient to practice the invention. The link member 126 is disposed adjacent a first periphery portion 128 of the tilt member 104 and toward rear portion 112 of the support member 102.

Referring again to FIGS. 6, 7, 8 and 9, the rotatable member 106 is shown having a generally plate-like shape. It should be appreciated that the rotatable member 106 could be made in any number of shapes. For example, it could be a box-like member or have a generally rectangular shape. The rotatable member 106 may have a shape that is different from the shapes of the tilt member 104 and/or the rotatable member 106.

The rotatable member 106 is disposed substantially parallel to the tilt member 104. The rotatable member 106 has a top side 130 and a bottom side 132. The rotatable member 106 is rotatably attached to the tilt member 104. The rotatable member 106 includes a mounting hole 134, as shown in FIG. 8. The mounting hole 134 is preferred to be coaxial with an axis of rotation 136. A shaft 138 extends from about the top side 122 of the tilt member 104 along the axis 136 through the hole 134. A washer 140 and a cotter pin 142 are disposed around and through, respectively, the shaft 138 in a traditional fashion to rotatably attach the rotatable member 106 to the tilt member 104. The shaft 138 is welded to the top side 122 of the tilt member 104. It should be appreciated that any fastener that enables the rotatable member 106 to rotate relative to the tilt member 104 would be sufficient to practice the invention.

A spacer (or bearing member) 144, shown in hidden lines in FIGS. 6 and 7, is disposed between the rotatable member 106 and the tilt member 104. The spacer 144 is disposed about the shaft 138. The spacer 144 is adapted to facilitate the movement of the rotatable member 106 relative to the tilt member 104. The spacer 144 is preferably made of acrylic. The spacer 144 preferably has a generally plate-like shape. The spacer 144 includes a plurality of orifices 146. The orifices 146 are disposed at various radial lengths and distributed about the spacer 144. It is preferred, but not necessary, that the spacer 144 have a plurality of arms or legs; one for each of the orifices, as shown in FIGS. 6 and 7. The orifices 146 are operably configured to retain ball bearings 148 between the tilt member 104 and rotatable member 106. The spacer 144 has a thickness that is less than the diameter of the ball bearings 148. The ball bearings 148 are disposed in the spacer 132 such that they rotate freely when the rotatable member 106 is rotated. The ball bearings 148 contact the top side 122 of the tilt member 104 and the bottom side 132 of the rotatable member 106 so as to facilitate rotation of the rotatable member 106.

It should be appreciated that there are numerous other ways to allow for rotation of the rotatable member 106 relative to the tilt member 104. For example, grease or some other lubricant may be placed between the plates, or the plates may be made or coated with a low-friction material, such as Teflon, that facilitates rotation. Alternatively, a Teflon spacer without ball bearings could be inserted between the tilt and rotatable members.

As shown in FIGS. 6 and 7, the rotatable member 106 also preferably includes a mounting bracket 150. The mounting bracket 150 is fixed to the top side 130 of the rotatable member 106. The mounting bracket 150 includes a ball launching attachment portion 152 and a hopper attachment portion 154. It should be appreciated that the attachment portions 152 and 154 may be separated and separately attached to the rotatable member 106.

The ball launching attachment portion 152 includes a guide 156, a catch member 158, and a hold-down member 160. The guide 156 preferably has a shape that is configured to receive a mounting frame, not shown in FIGS. 6 and 7, of the ball launching device 200. Preferably, the guide 156 has a generally U-shape in the plane of the rotatable member 106. However, it should be appreciated that in other various exemplary embodiments, the guide can be other shapes so as to engage the shape of the mounting frame of the particular ball launching device being utilized.

The catch member 158 is disposed so as to be spaced from the guide 156 such that a portion of the frame of the ball launching device, not shown, will be disposed between the guide 156 and the catch member 158 when the ball launching device is attached. The catch member 158 is operably configured to assist in preventing the ball launching device 200 from sliding backward away from or out of the U-shaped guide 156.

The hold-down member 160 is preferably a bar. The hold-down member 160 includes an orifice 162 at both ends thereof. The hold-down member 160 is attachable to the rotatable member 106 by threaded bolts 164 disposed in the orifices 162. The bolts 164 engage threaded receptacles 166 disposed on the top side 130 of the rotatable member 106. The hold-down member 160 is operably configured to be disposed over a portion of the ball launching device 200 to hold the device 200 to the rotatable member 106.

The hopper attachment portion 154 of the mounting bracket 150 includes rods 168. The rods 168 are operably configured to be inserted in support members of the hopper 400 as will be discussed further below.

Referring again to FIG. 5, the first actuator assembly 108 is shown including an actuator 170. The actuator 170 is connected to the tilt member 104 and the support member 102. The actuator 170 is operably configured such that when it is actuated, i.e. extended or retracted in its length, the tilt member 104 will move relative to the support member 102. The actuator 170 is preferably an electro-hydraulic actuator. The actuator 170 has a shaft 172, a housing 174 and a motor 176. The housing 174 is adapted to house the shaft 172, such that the shaft 172 is able to move in and out of the housing 174. The shaft 172 has a first end 173. The first end 173 is attached to the tilt member 104. Preferably, the first end 173 is pivotally attached to the tilt member 104. The first end 173 is attached to a second periphery portion 178 of the tilt member 104. Preferably, the second periphery portion 178 is substantially diametrically opposed to the first periphery portion 128, as shown in FIG. 8.

The motor 176 is an electric motor operably configured to selectively extend or retract the shaft 172 in to and out of the housing 174.

The first actuator assembly 108 also includes a bracket 179. The housing 174 is attached to the support member 102 via the bracket 179. The bracket 179 preferably includes supports 180 and cross supports 181 and 182, as shown in FIG. 5. The supports 180 are preferably disposed in a parallel relationship. The supports 180 are disposed parallel to the housing 174. Each support 180 has a first and second end 183 and 184, respectively. The first ends 183 of the supports 180 are pivotally attached to the support member 102. The first ends 183 are preferably attached to the front 113 portion on the outer periphery of the support member 102. The front portion 113 is substantially diametrically opposed to the rear portion 112. The housing 174 is pivotally attached to the supports 180 via bolts 163. The bolts 163 extend from the supports 180 into holes 165 in the housing 174, as shown in FIGS. 5 and 6. The cross supports 181 and 182 are disposed substantially perpendicular to the supports 180. The cross supports 181 and 182 hold the actuator 170. To hold the actuator 170, the cross support 181 is disposed behind the actuator 170 and the cross support 182 is disposed in front of the actuator 170. In operation, the actuator 170 pivots at the connection with the bolts 163, and as the shaft 172 is extended the housing 174 presses against the cross support 181 so as to pivot the entire actuator assembly 108 at the first ends 183 of the supports 180.

It should be appreciated that any actuator attached to the support member 102 and to the tilt member 104 and adapted to lift and hold the tilt member 104, the ball launching device 200, and the hopper 400 relative to the support member 102, as described above, would be sufficient to practice the present invention. An off the shelf linear actuator that was used in an actual reduction to practice for the first actuator assembly is one made by Warner, model no. P24-05B5-18RD.

Referring again to FIGS. 9 and 10, the second actuator assembly 110 includes an actuator 185 and linkage 186. A fixed end 187 of the actuator 185 is attached to the support member 102. Preferably, the fixed end 187 is attached to the support member 102 via a bracket. Further, it is preferable that the fixed end 187 is attached in such a manner so that the actuator 185 can move or pivot slightly when the actuator is actuated. The pivot movement is preferably in a plane that includes the longitudinal axis of the actuator 185. An extendable end 188 of the actuator 185 is attached to the linkage 186. The extendable end 188 is operably configured to extend away from and retract towards the fixed end 187 based on the selection of an operator. Preferably, the actuator 185 is an electro-hydraulic linear actuator that includes a housing 189, an extendable member 190 and a motor 191. An off the shelf actuator that was used in an actual reduction to practice for the first actuator assembly is a linear actuator made by Warner, model no. DE24-17W44-08NPMHN. It should be appreciated that any variety of other actuators may be used for actuator 185.

The extendable member 190, in a non-actuated state, resides substantially within the housing 189. When actuated by the motor 191, the extendable member 190 extends from and in to the housing 189. The extendable end 188, which is the free end of the extendable member 190, is attached to the linkage 186. FIG. 10 shows the extendable member 190 more extended from the housing 190 than in the FIG. 9. When the extendable member 190 extends from the housing 189, the rotatable member 106 will rotate counter-clockwise and visa versa when the extendable member 190 is retracted.

The linkage includes a pivot member 192, an intermediate member 193, and an attachment member 194. The pivot member 192 has a pivot end 195 and a second end 196. The pivot end 195 is attached to the support member 102. Preferably, the pivot end 195 is attached to a portion of the periphery of the support member 102. Preferably, the pivot member 192 has the general shape of a bar having a larger dimension in its width than its thickness. In this exemplary embodiment, the pivot member 192 is twisted along its length. The twisting facilitates the attachment of the pivot member 192 to the extendable end 188 of the actuator 185 and the intermediate member 193, as shown in FIG. 9. It is preferable that the pivot member 192 be twisted approximately 180 degrees along its length, as shown in FIG. 9. The extendable end 188 is pivotally attached to the pivot member 192, preferably near the midpoint along the length of the pivot member 192. When the actuator 185 is actuated to extend and retract the extendable end 188, the pivot member 192 will pivot about the pivot end 195.

The intermediate member 193 has a first end 197 and a second end 198. The first end 197 is attached to the second end 196 of the pivot member 192. The first end 197 is attached to the second end 196 of the pivot member 192, such that the intermediate member 193 pivots about the second end 196 when the pivot member 192 is actuated by the actuator 185. A universal joint 199 is attached to the second end 198 of the intermediate member. The universal joint 199 is attached to the attachment member 194. The universal joint 199 engages a threaded shaft attached to the second end 198, as shown. The attachment member 194 is attached to the rotatable member 106. Preferably, the attachment member 194 is attached to a rear periphery portion 107 of the rotatable member 106. The universal joint 199 is attached to the attachment member 194 with a nut as shown. However, it should be appreciated that the universal joint 199 could be removably attached to the attachment member in a variety of ways. For example, a rod and a pin could be used.

The universal joint 199 allows for multi-directional relative movement of the intermediate member 193 relative to the attachment member 194. When the actuator 185 is actuated to extend or retract the extendable end 188, the intermediate member 193 will move in substantially the same plane as the actuator 185. Further, the intermediate member 193 will pivot about the second end 197 of the pivot member 192 and will move the attachment member 194 so as to rotate the rotatable member 106.

The universal joint 199 has enough degrees of freedom of movement to be able to swivel in multiple directions such that when the actuator assembly 108 is actuated to tilt the tilt member 104 and the rotatable member 106 relative to the support member 102, the second actuator assembly 110 will still be operable to rotate the rotatable member 106.

The rotational movement of the rotatable member 106 is preferably limited by the stops 120, as described above. Particularly, the rotation of the rotatable member 106 is limited when the attachment member 194 comes into contact with either of the stops 120. The actuator 189 is preferred to include an internal clutch so that the actuator will not burn-out when the rotation of the rotational member 106 is stopped by the stops 120.

With the above configuration, the second actuator assembly 110 is operably configured such that actuation of the actuator 185 causes panning of the rotatable member 104. The second actuator assembly 110 is adapted to pan the rotatable member 106 through the desired amount of rotation. Preferably, the rotation is through at least 110°. In other embodiments it is preferably to rotate through at least 120°, 100°, 90°, 80°, 70° or 60° in either direction.

The actuators 174 and 189 of the first and second actuator assemblies 108 and 110, respectively, are controlled by links 167, as shown in FIG. 5. Links 167 provide electrical connections to the controller 500, such that a user can control the respective actuators. It should be appreciated that the links 167 can be any known or later developed device or system connecting the respective devices to the controller 500, including a direct cable connection, a radio frequency communication connection, infa-red, etc. Further, it should be appreciated that the control signals do not need to be sent along the links in the same manner that the power is sent. For example, the power can be sent via a direct cable connection and the control signal can be via a radio frequency.

Figure 11:
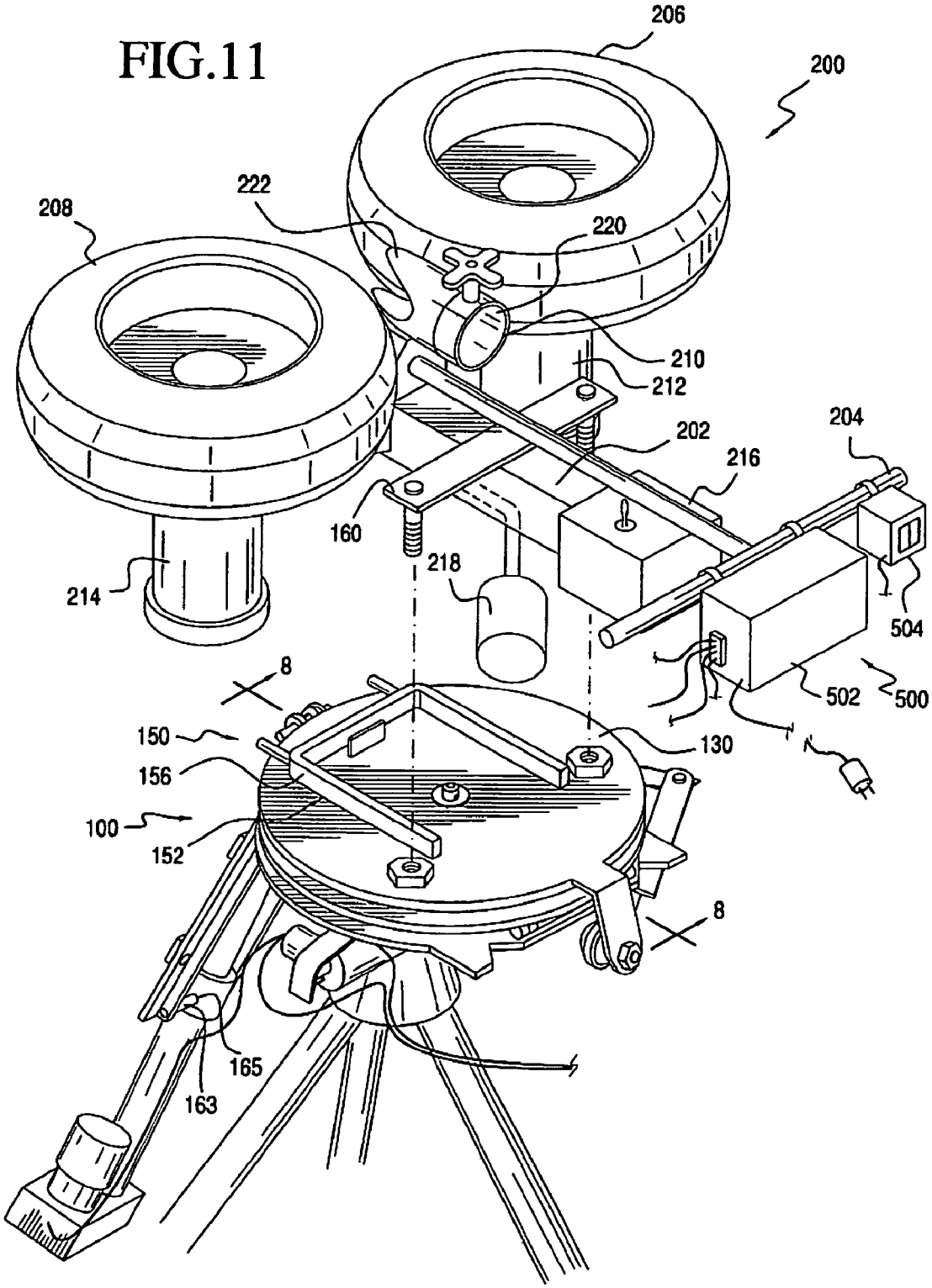
FIG. 11 is an exploded side perspective view of the ball launching device, the ball directing devices and the support stand of FIG. 1.

FIG. 11 is a perspective view of the ball launching device 200, device controller 500 and the ball directing device 100. The ball launching device 200 generally includes a frame 202, as shown in FIG. 5, a handle 204, two wheels 206, 208, a feed tube 210, two motors 212, 214, and a controller 216.

The ball launching device also includes an attachment rod 218 attached to the frame 202. The attachment rod 218 is optional and is for use with a standard or conventional tripod assembly, when the ball directing device 100 is not used as is discussed further below in connection with the prior art device. It should be appreciated that the attachment rod 218 is optional. In general, the attachment rod will only be present when the ball launching device is taken from an existing, conventional pitching machine wherein the launching device is designed to be attached to a conventional tripod. The ball launching device of the present invention can be, in various exemplary embodiments, the ball launching device of a pitching machine manufactured and sold by Jugs of Tualitin, Oreg., (e.g., model numbers M1000 and M1300, Combination Pitching Machines, www.thejugscompany.com, which are incorporated herein by reference in their entireties). It should be appreciated that different types of ball launching devices, i.e. pitching machines, etc., may be utilized in other various exemplary embodiments of the present invention. For example, it may be practiced with a ball launching device, such as the ATEC, model name Casey. Further, it is understood that a single wheel ball launching device can be utilized as the ball launching device of the present invention.

The frame 202 is attached to the rotatable member 106, as will be described further below. The feed tube 210 is attached to the top side of the frame 202. The feed tube is disposed adjacent to and between the wheels 206 and 208. The feed tube 210 has a first end 220 and a second end 222. The tube has a diameter such that a ball, not shown, of a desired type e.g., a baseball, softball, tennis ball, etc., can travel through the tube 210. The first end 220 is adapted to receive the ball. Preferably, the ball is fed to the feed tube 210 from the ball hopper 400, not shown in FIG. 11, as will be discussed further below. The second end 222 is adapted to deliver the ball to a position so that the ball will come into contact with the wheels 206 and 208 and the ball will be launched or ejected by the rotation of the wheels 206 and 208, as is commonly understood.

The wheels 206, 208 are rotatably attached to the frame 202. Preferably, the axes of the wheels 206 and 208 are substantially perpendicular to the plane of the rotatable member 106. The wheels 206 and 208 are driven by motors 250 and 260, respectively. Motors 250 and 260 are preferably electric motors. Motors 250 and 260 are preferably electrically connected to controller 216. Controller 216 is attached to the frame 202. Controller 216 controls the rotational speed of the motors 250 and 260 and hence the wheels 206 and 208. The controller 216 in other various exemplary embodiments is electrically linked to the controller 500 so the user can control the ball launching device from the controller 500.

The ball launching device 200 is attached to the top side 130 of the rotatable member 106. The frame 202 has a shape that is configured to engage the guide 156 of the ball launching attachment portion 152 of the mounting bracket 150 as discussed above. The hold-down member 160 is disposed over the frame 202, as shown in FIG. 11. The hold-down member 160 attaches the ball launching device 200 to the rotatable member 106.

It should be appreciated that in other various exemplary embodiments, the ball launching device 200 is attached to the rotatable member 106 permanently, such as through welding, etc.

Referring again to FIGS. 1 through 4, the support stand 300 is shown. The support stand 300 includes a mounting support 302 and a plurality of legs. In this exemplary embodiment, there are three legs, 304, 306, 308. Preferably, the support stand 300 further includes wheels 310, 312, 314, 316 and a handle 318.

The mounting support 302 has a first end 320 and a second end 322, as shown in FIG. 2. The first end 320 is preferably hollow. The first end 320 is adapted to receive the attachment member 118 of the directional device 100. The second end 322 is preferably hollow. The second end 322 is adapted to receive the legs 304, 306, and 308.

The legs 304, 306 and 308, shown in FIG. 2, are attached to the second end 322 of the mounting support 302. A securing member 324 engages, preferably by threads, not shown, the second end 322. The securing member 324 secures the legs 304, 306 and 308 by wedging them against the interior wall of the mounting support 302. The securing member 324 secures the legs 304, 306, and 308 to the mounting support 302. The securing member 324 engages the second end 322 similar to conventional tripods for conventional pitching machines.

The legs 306 and 308 are preferably generally disposed on either side of the first actuator assembly 108, as shown in FIG. 4. The leg 304 opposes the legs 306 and 308 so as to provide stable support for the device 10. At ends opposite the ends that engage the second end 322 of the mounting support 310, the legs 304, 306 and 308 are each connected to at least one wheel. In this exemplary embodiment, the legs 304, 306 and 308 engage axle housings 326, 328 and 330, respectively. Wheels 310 and 312 are rotatably attached to the axle housing 326 via axles 332 and 334. Preferably, the wheels 310 and 312 are disposed on opposite sides of the axle housing 326. The wheel 314 is rotatably attached to the axle housing 328 via an axle 336. The wheel 316 is rotatably attached to the axle housing 330 via an axle 338.

As shown in FIG. 1, each axle housing 326, 328, and 330 includes a sleeve 340 adapted to receive the legs 304, 306 and 308. The weight of the device holds the respective legs in the corresponding sleeves. However, it should be appreciated that in other alternative embodiments, each sleeve can include a hole adapted to receive a fastener to secure the legs in the sleeves.

As shown in FIG. 4, a cross support 342 extends between the axle housings 328 and 330. Preferably, each of the axle housings 328 and 330 has an interior open end to receive opposite ends of the cross support 342. The cross support is secured by threaded pins 344.

A user will use the handle 318 to move the device 10 around. The handle 318 is pivotally attached to the axle housing 326. When not in use, the handle 318 is pivoted up and temporarily secured to the leg 304. Note, for clarity purposes, the leg 308 is broken along its length and the cross support 342, wheel 316 and axle housing 330 are not shown in FIGS. 2 and 3.

Figure 12:
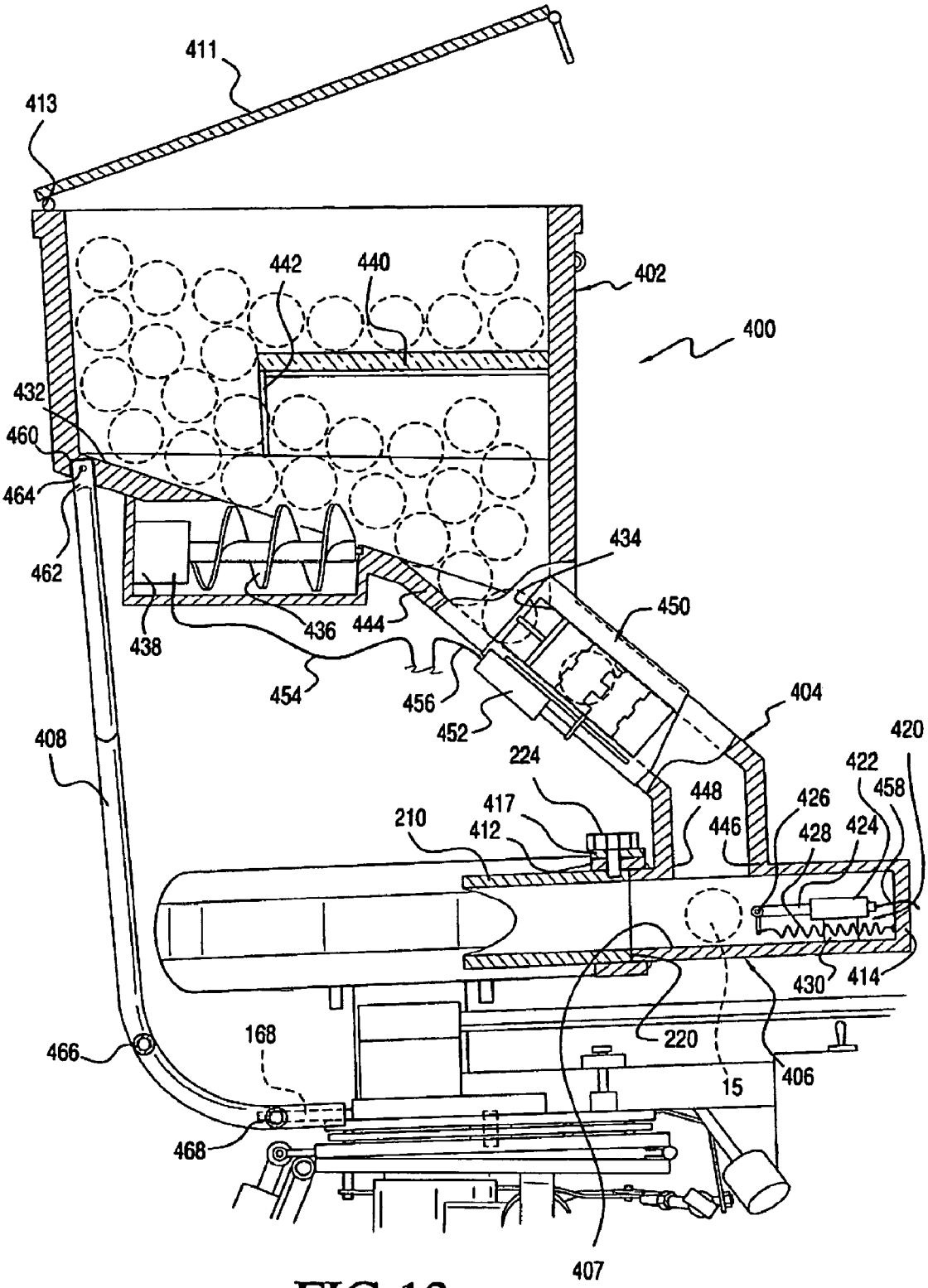
FIG. 12 is a partial side cross-sectional view of the hopper of FIG. 1.
Figure 13:
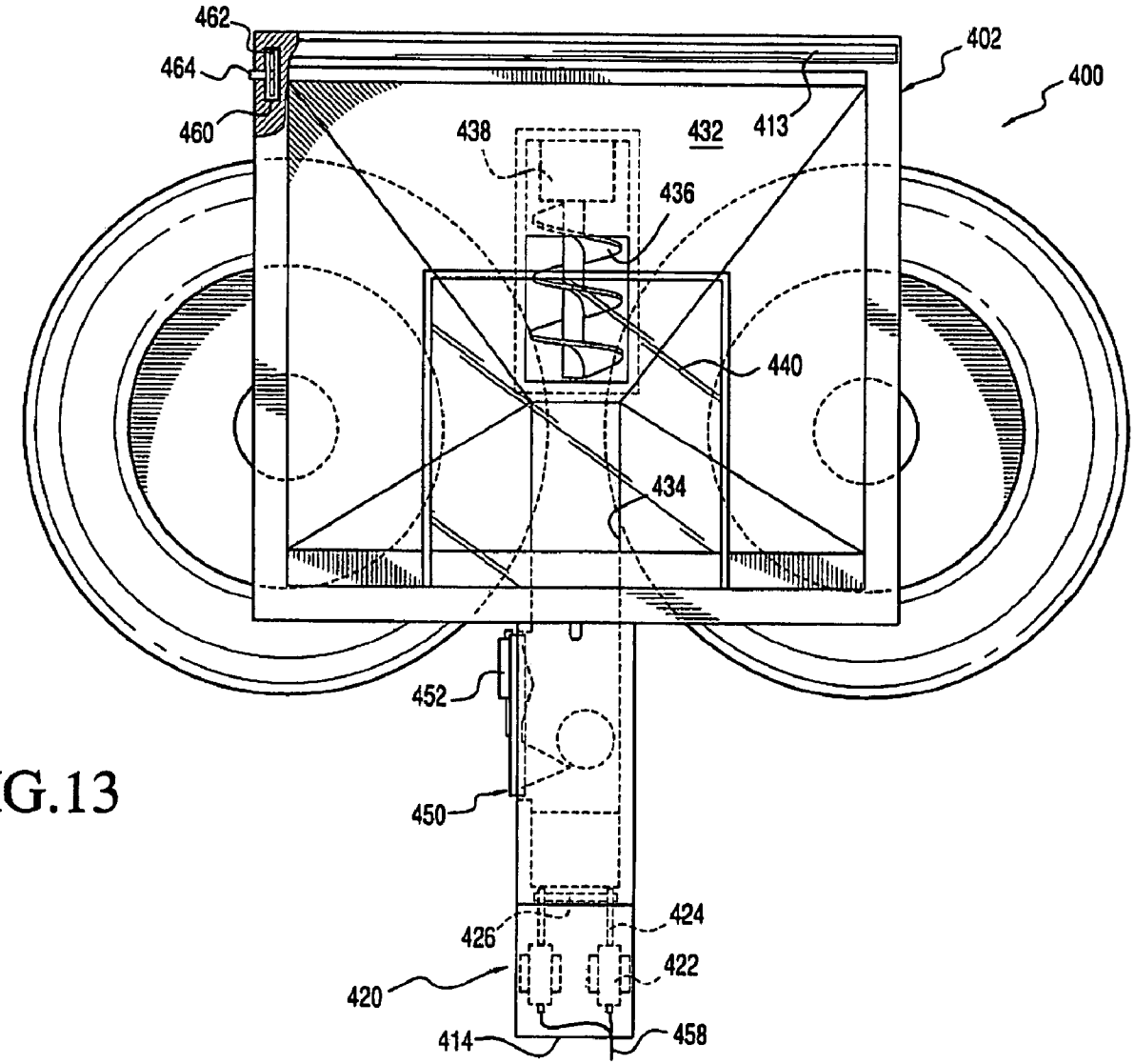
FIG. 13 is a top view of the hopper of FIG. 12.

FIGS. 12 and 13 display the ball hopper 400. FIG. 12 displays a partial cross-sectional view of the ball hopper 400 and FIG. 13 displays a top view of the ball hopper 400. Note, only the ball hopper 400 is shown in cross-section in FIG. 12. The ball hopper 400 includes a bin 402, a chute 404, and an engagement (or delivery) portion 406. The hopper 400 further includes two support legs 408 and 410, (shown in FIG. 1). Cross supports 466 and 468 are disposed between and connected to the legs 408 and 410. The cross support members assist in stabilizing the hopper 400. It should be appreciated that in other various exemplary embodiments, there can be more, less or no cross support members and further that the support legs can be combined into one member. In various exemplary embodiments, the hopper further includes a lid 411, as shown in FIG. 12 (not shown in FIG. 13). The lid 411 is attached to the bin 402 via a hinge 413.

Each of the support legs 408 and 410 is attached at one end, an attachment end 462, to the bin 402. The opposite end of each of the support legs 408 and 410 is attached to the rods 168 of the hopper attachment portion 154 of the ball directing device 100, discussed above. The attachment end 462 of each of the support legs 408 and 410 extends through holes 460 disposed in the bottom of the bin 402, as shown in the broken away portion of FIG. 13. Each of the attachment ends 462 are preferably flattened or crimped. Fasteners 464 attach the attachment ends 462 to the bin 402. The fasteners 464 are preferably bolts.

The engagement portion 406 is substantially hollow and has an interior ball channel 407. The engagement portion 406 includes a first end 412 and a second end 414. The first end 412 of the engagement portion 406 is attached to the first end 220 of the feed tube 210 of the ball launching device 200. The first end 412 is operably adapted to receive the first end 220 of the feed tube 210. The engagement portion 406 is secured to the feed tube via a screw 224 that extends through a partial slot 416 in the wall of the first end 412 and engages an exterior wall of the feed tube 210. A slide prevention bracket 417 (shown in FIGS. 1 and 2), is disposed between the head of the screw 224 and the exterior wall of the first end 412. The bracket 417 includes a partial slot 421 and orifices 418. The screw 224 extends through the slot 421. Protrusions 419 are disposed on the first end 412. Protrusions engage orifice 418 to hold the bracket 417. The bracket is operably configured to prevent the hopper 400 from slipping off the ball launching device 200.

The engagement portion 406 further includes a ball pushing member 420, as shown in FIGS. 12 and 13. The ball pushing member 420 includes solenoids 422, each have a shaft 424, which are connected together by an engagement bar 426. The springs 428 are attached to the bar 426 and the engagement portion 406. The solenoids 422 are supported by bracketing 430, which is secured to an interior wall of the engagement portion 406. The bracketing 430 is positioned such that the bar 424 is aligned with a ball 15 (shown in phantom), resting in the ball channel 407 of the engagement portion 406. The shafts 424 and the engagement bar 426 are driven by the solenoids 422. When the solenoids 422 are activated by the user, the solenoids 422 will cause the shaft to translate and the bar 426 will push the ball 15 along the ball channel 407, through the engagement portion, and into the first end 220 of the feed tube 210. When the solenoids 422 are deactivated, the springs 428 will force the shafts 424 and the bar 426 to return to their initial position (ready to push another ball).

The bin 402 is generally box-like in shape. The bottom interior surface 432 of the bin 402 is angled to urge or funnel the balls to an opening 434. The opening 434 is adapted to allow balls to exit the bin 402. The bin 402 is adapted to store dozens of pre-launch balls. Preferably, the bin 402 is of a sufficient volume to store at least 100 baseballs, for example. In one exemplary reduction to practice, wherein the bin is capable of storing at least 100 baseballs, the bin has a depth of about 20 inches.

The bin 402 also includes an auger 436 with a motor 438. The auger 436 is disposed adjacent the bottom interior surface 432. The auger 436 is aligned so as to encourage the flow and/or dislodge the balls as the balls move toward the opening 434.

The bin 402 also includes a shelf 440. The shelf 440 is disposed above the bottom interior surface 432. The shelf 440 is disposed above the bottom interior surface 432 at a height that is greater than the diameter of a ball to be placed in the bin 402. The shelf 440 is configured to be disposed above the opening 434. The shelf 440 supports the weight of some of the balls in the bin 402 so as to assist in preventing clogging of the balls at the opening 434. The shelf is attached along at least one edge to a side wall of the bin 402. The shelf is supported by supports 442. Supports 442 extend from the bottom interior surface 432 to the shelf 440. The shelf 440 is preferably transparent, such that a user can visually see the opening 434 when looking in the bin 402.

The chute 404 has a first end 444 and a second end 446. The first end 444 is attached to the opening 434. The second end 446 is attached to an opening 448 in the engagement portion 406. The opening 448 is of a sufficient diameter to allow a ball to pass into the engagement portion. The opening 448 is preferably disposed such that when a ball passes, the ball will land adjacent to the bar 426 when the solenoids 422 are in a non-actuated state. In this exemplary embodiment, the chute 404 is shown to be integral with the engagement portion 406 and integral with the bin 402. However, it should be appreciated that the chute, in other various exemplary embodiments, not shown, is not integral with the engagement portion and/or the bin.

The chute 404 also includes a ball flow control device 450. The flow control device 450 is disposed along the length of the chute 404. The device 450 is disposed adjacent to the flow path of the balls that travel through the chute 404, so as to engage the balls. The device 450 regulates the flow of the balls from the bin 402 to the engagement portion 406. The device 450 controls the balls such that the balls do not clog in the engagement portion 406. It is preferred that the device 450 allow one ball at a time, i.e. per activation of the device 450. The device 450 is activated by the user to release a ball into the engagement portion 406.

In this exemplary embodiment, the device 450 is a conventionally available gating device. For example, the device 450 is a gating device commonly used to control the dispensing of bottles and cans from vending machines. It is preferred that the device be a tall gate product manufactured by Dixie-Narco, Inc., (www.gfv.dixienarco.com, see Dixie-Narco, Inc.'s parts list for vending machine model number DN 5000, "DN 5000 Parts", pgs. 12 and 13, which is incorporated herein by reference in its entirety). The tall gate product is actuated by a solenoid 452. The solenoid 452 is electrically linked to the controller 500, such that a user can control its actuation.

It should be appreciated that any system adapted to release only one ball at a time from the chute would be sufficient to practice the present invention.

The lid 411 is adapted to prevent the balls from falling out when the ball launching machine is lifted or tilted-up.

The auger 436, the device 450, and the ball push member 420 are linked to the controller 500 via links 454, 456, and 458 respectively. It should be appreciated that the links 454, 456, and 458, or any two of them, can be combined in alternative embodiments, not shown. The links 454, 456, and 458 provide power to the respective devices. The links 454, 456, and 458 provide control signals from the controller 500 to the respective devices. It should be appreciated that the links 454, 456, and 458 can be any known or later developed device or system connecting the respective devices to the controller 500, including a direct cable connection, a radio frequency communication connection, infa-red, etc. Further, it should be appreciated that the control signals do not need to be sent along the links in the same manner that the power is sent. For example, the power can be sent via a direct cable connection and the control signal can be via a radio frequency. It will be appreciated that in other exemplary embodiments, the hopper 400 has its own controller, separate from controller 500, to which the links 454, 456, and 458 connect.

Figure 14:
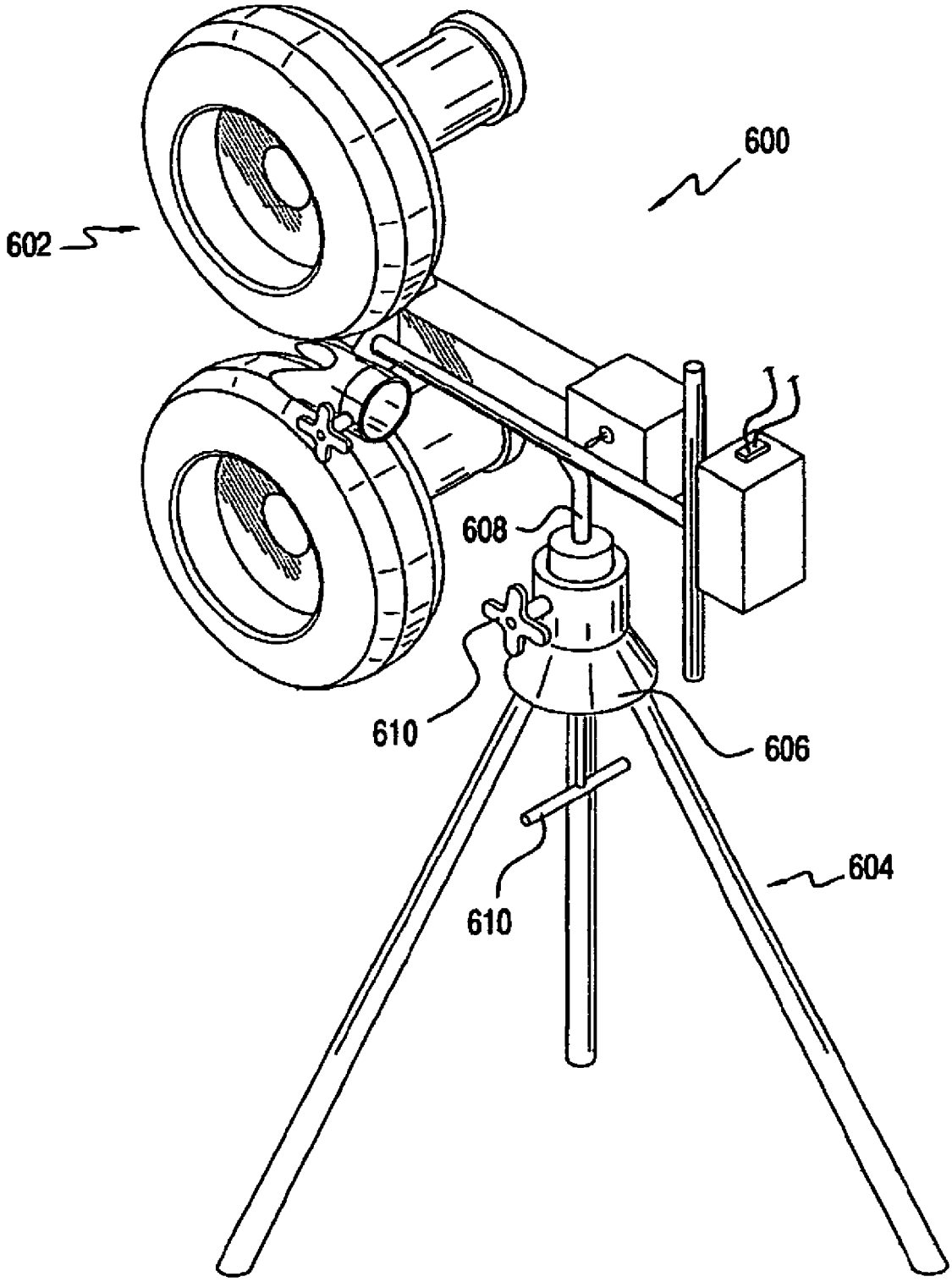
FIG.14 (Prior Art)
FIG. 14 is a side perspective view of a prior art ball throwing device.

The present invention also includes a method for modifying a pitching machine with a ball launching device into a pitching/fielding machine with automatic control over orientation of the ball launching device. FIG. 14 displays a conventional, prior art pitching machine 600. The pitching machine 600 includes a ball launching device 602 and a support stand 604. The ball launching device 602 is similar to the ball launching device 200, described above. The support stand 604 is a tripod with a mounting support 606 that receives an attachment member 608 of the ball launching device 602. These types of pitching machine are made by a variety of entities, for example, JUGS (e.g. model nos. M1000/M1300) or ATEC (e.g. model name Casey).

Figure 15:
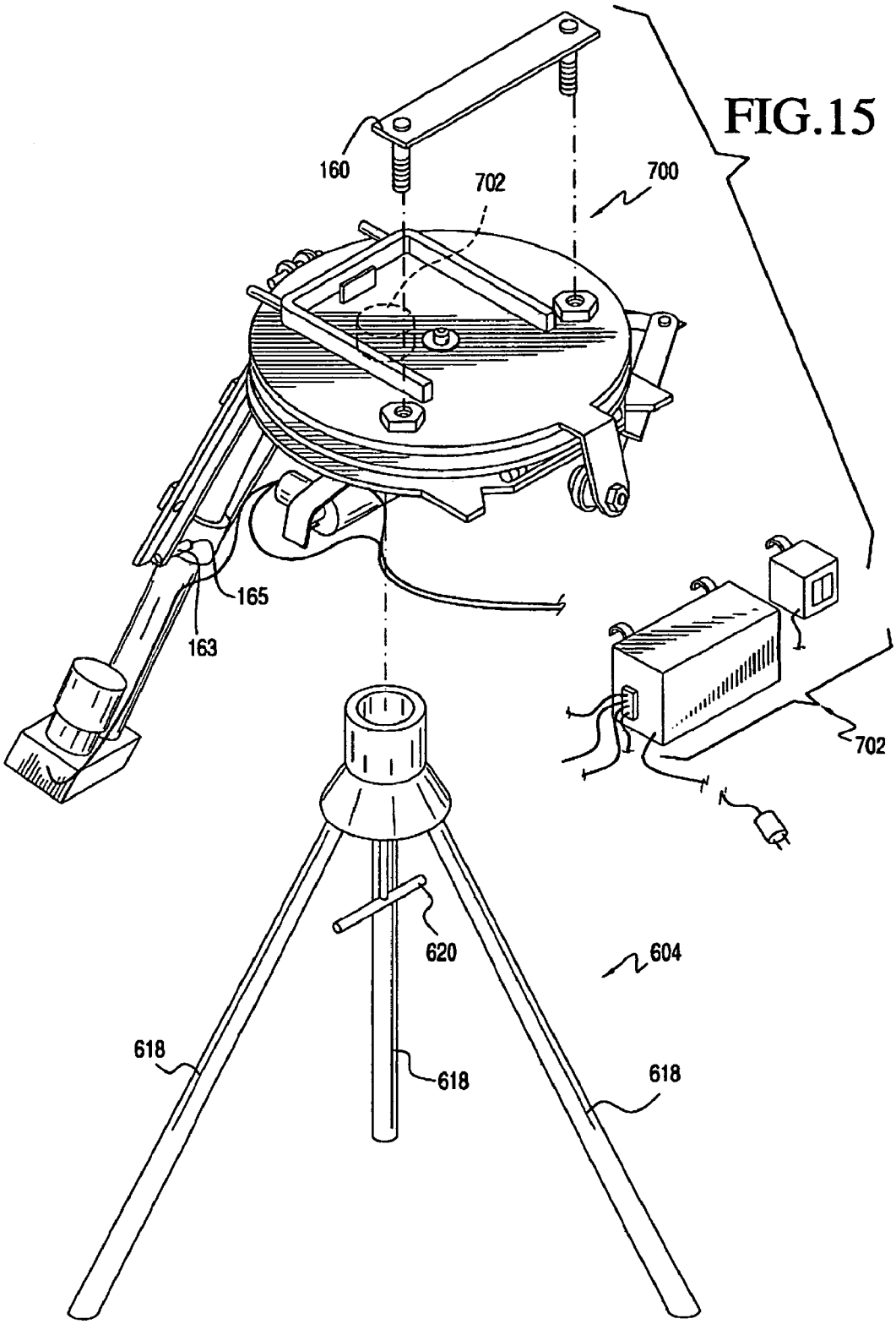
FIG. 15 is an exploded side perspective view of a ball directing device made in accordance with this invention, shown with the support stand of the prior art ball throwing device of FIG. 14.
Figure 16:
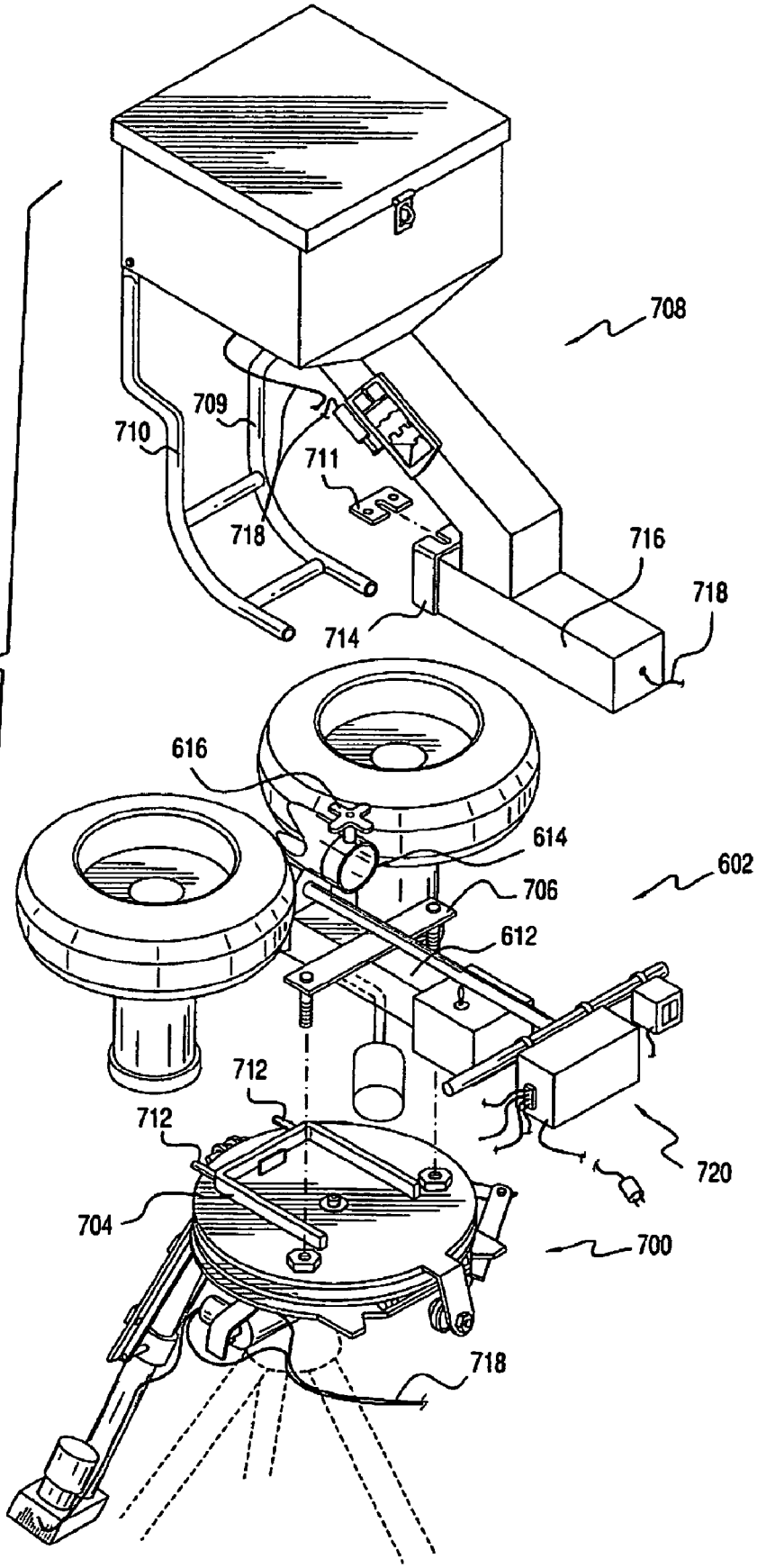
FIG. 16 is an exploded side perspective view of a hopper, made in accordance with this invention, with the prior art ball launching device of FIG. 14 and the ball directing device of FIG. 15.

The method of modifying an existing pitching machine in accordance with the present invention is generally shown in FIGS. 15 and 16. This method includes the steps of removing the ball launching device 602 from the support stand 604 of the conventional pitching machine 600, attaching a ball directing device 700, made in accordance with the present invention, to the support stand 604, and attaching the ball launching device 602 to the ball directing device 700.

Removing the ball launching device 602 from the support stand 604 of the conventional pitching machine 600 includes removing a securing fastener 610 from the mounting support 606. The securing fastener 610 extends through the wall of the mounting support 606 and engages a threaded hole, not shown, in the attachment rod 608. With the fastener 610 removed, the ball launching device 602 is removed from the support stand 604.

The ball directing device 700 is similar to the ball directing devices 100 described above. The device 700 includes an attachment member 702, shown in hidden lines. Attaching the ball directing device 700 includes inserting the attachment member 702 in the mounting support 606 of the support stand 604, as shown in the exploded view of FIG. 15. Preferably, although not necessary, the fastener 610 is inserted in the mounting support 606 and engages a threaded hole, not shown, in the attachment member 802 to secure the directing device 700 to the support stand 604.

Attaching the ball launching device 602 to the ball directing device 700 includes securing a frame 612 of the ball launching device 602 to the ball directing device 700 via a mounting bracket 704, which includes a hold-down member 706. The frame 612 is secured to the mounting bracket 704 similar to the way the frame 202 is secured to the mounting bracket 150 as described above with the device 10.

The method of modifying a pitching machine, according to the present invention, further includes attaching a hopper 708 to the ball launching device 602 as shown in FIG. 16. The hopper 708 is similar to the hopper 400 described above. The attaching the hopper step includes engaging support legs 710 with rods 712 of the ball directing device 700. The attaching the hopper step further includes engaging a first end 714 of an engagement portion 716 of the hopper 708 to a feed tube 614 of the ball launching device 602. The first end 714 is secured to the feed tube 614 via a threaded screw 616. A rectangular-shaped slip prevention bracket 711 is disposed between the head of the screw 616 and hopper, similar to the slip prevention bracket discussed above, to prevent detachment of the ball hopper. It should be appreciated that attaching the hopper is optional.

The method further includes attaching links 718 to a controller 720 of the ball directional device 700. The links 718 are similar to the links discussed above for the device 10.

The method of modifying an existing pitching machine according to the present invention further includes converting the support stand to a wheeled support stand, not shown in FIGS. 15 and 16. The wheeled support stand is similar to the support stand 300, disclosed above and shown in FIG. 1 for example. This converting step includes removing legs 618 (FIG. 15) from the mounting support 606. The legs 618 are removed by loosening a screw 620 that engages the mounting support 606. The converting step further includes inserting new legs, similar to legs 304, 306 and 308 described above, in the mounting support 606. The new legs are preferably shorter than the original legs of the support stand 604. Screw 620 is then tightened to secure the legs to the mounting support 606.

The converting step further includes securing axle housings and wheel assemblies, similar to those described above, to the free ends of the new legs. A cross member is then secured between two of the axle housings. Further, a pivotable handle is secured to the axle housing that is not connected to the cross member. It should be appreciated that the converting step is optional. It is preferred that the converting step be conducted after the removing of the ball launching device 602 step and before the attaching of the ball directing device 700 step.

The automatic ball delivery device 10, described above, is an embodiment of the present invention that can be used for a variety of purposes, such as throwing balls in the air, on the ground etc. However, it is preferred that with the embodiment described above, that the device 10 be used primarily for baseball/softball defensive practice or in any other situation wherein it is desired to throw a ball with primarily a side spin. There are situations, however, were it is desirous to be able to throw a ball with any type of directional spin.

Figure 17:
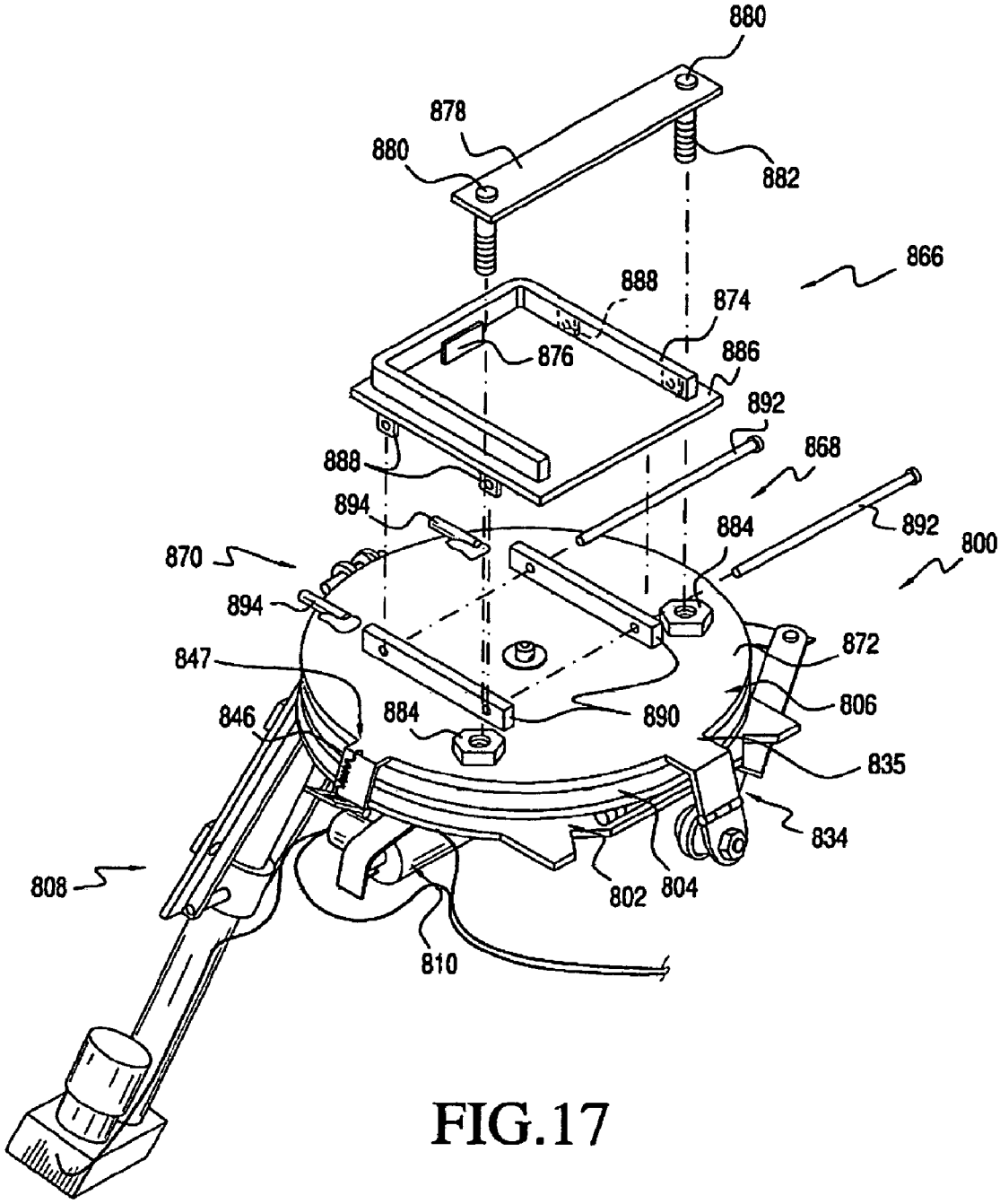
FIG. 17 is an exploded side perspective view of an alternative embodiment of a ball directing device made in accordance with this invention.
Figure 19:
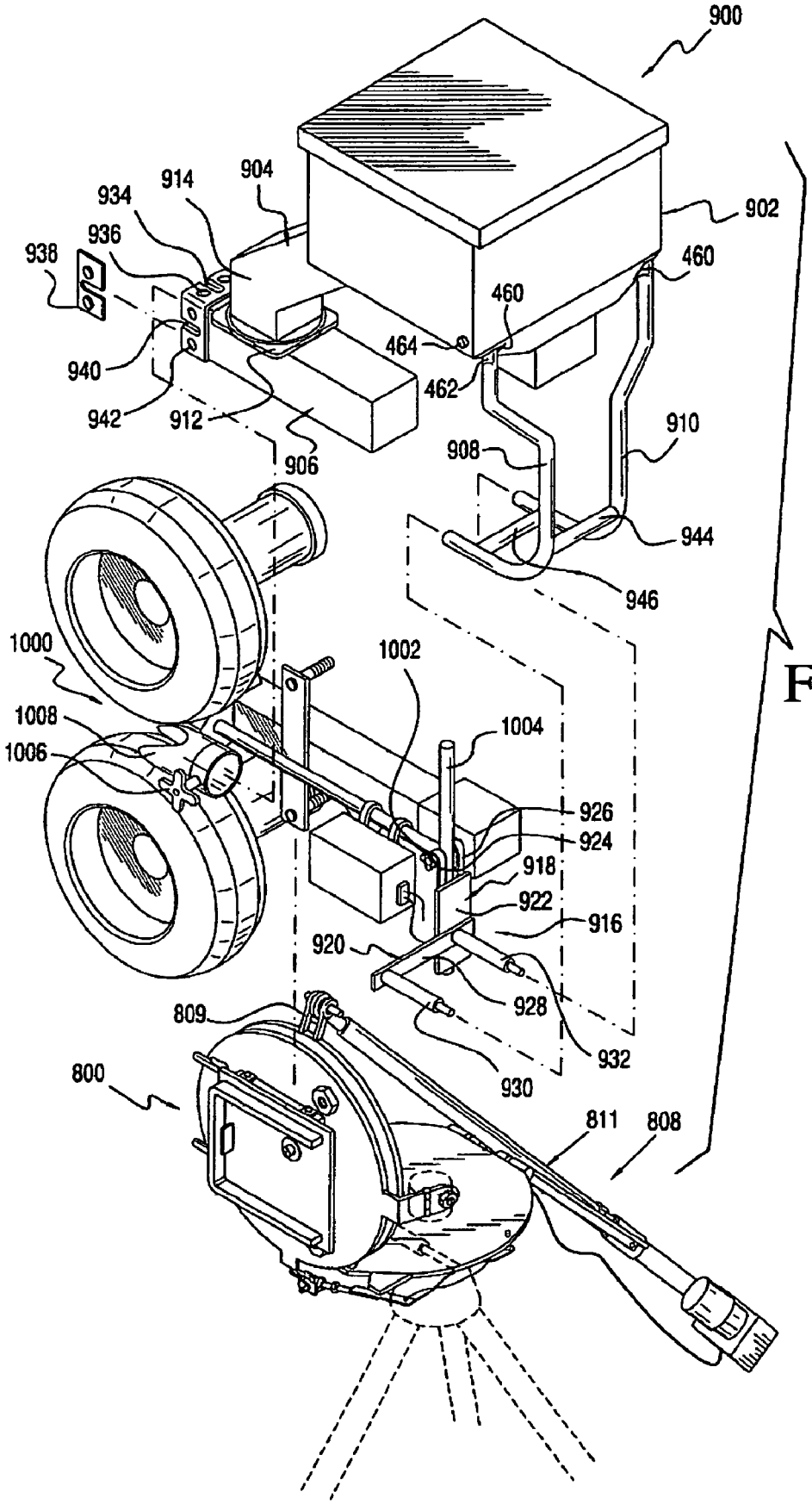

FIG. 17 displays a ball directing device 800, which is an alternative embodiment of a ball directing device made in accordance with the present invention. The ball directing device 800 will allow a user to orient a ball launching device in a variety of positions so as to be able to throw a ball with any type of directional spin. The device 800 is similar to the ball directing device 100 described above and includes similar features, such as for example a support member 802, a tilt member 804, rotatable member 806, a first actuator assembly 808 and a second actuator assembly 810. The second actuator assembly 810 includes a first attachment member 834. One of the differences in this embodiment is that the second actuator assembly includes a second attachment member 846. The member 846 is operably configured such that when it is utilized, the tilt member 804 and the rotatable member 806 can selectively be pitched up via the first actuator assembly 808 to a substantially perpendicular relationship to the support member 802. The rotatable member 806 can then selectively be rotated via the second actuator assembly 810 so that the wheels of a ball launching device 880, shown in FIG. 19, are in a substantially vertical position. With the wheels in a substantially vertical position, a ball can be thrown with a forward or backward spin (e.g., the device can be used for more effective baseball/softball offensive practice).

Figure 18:
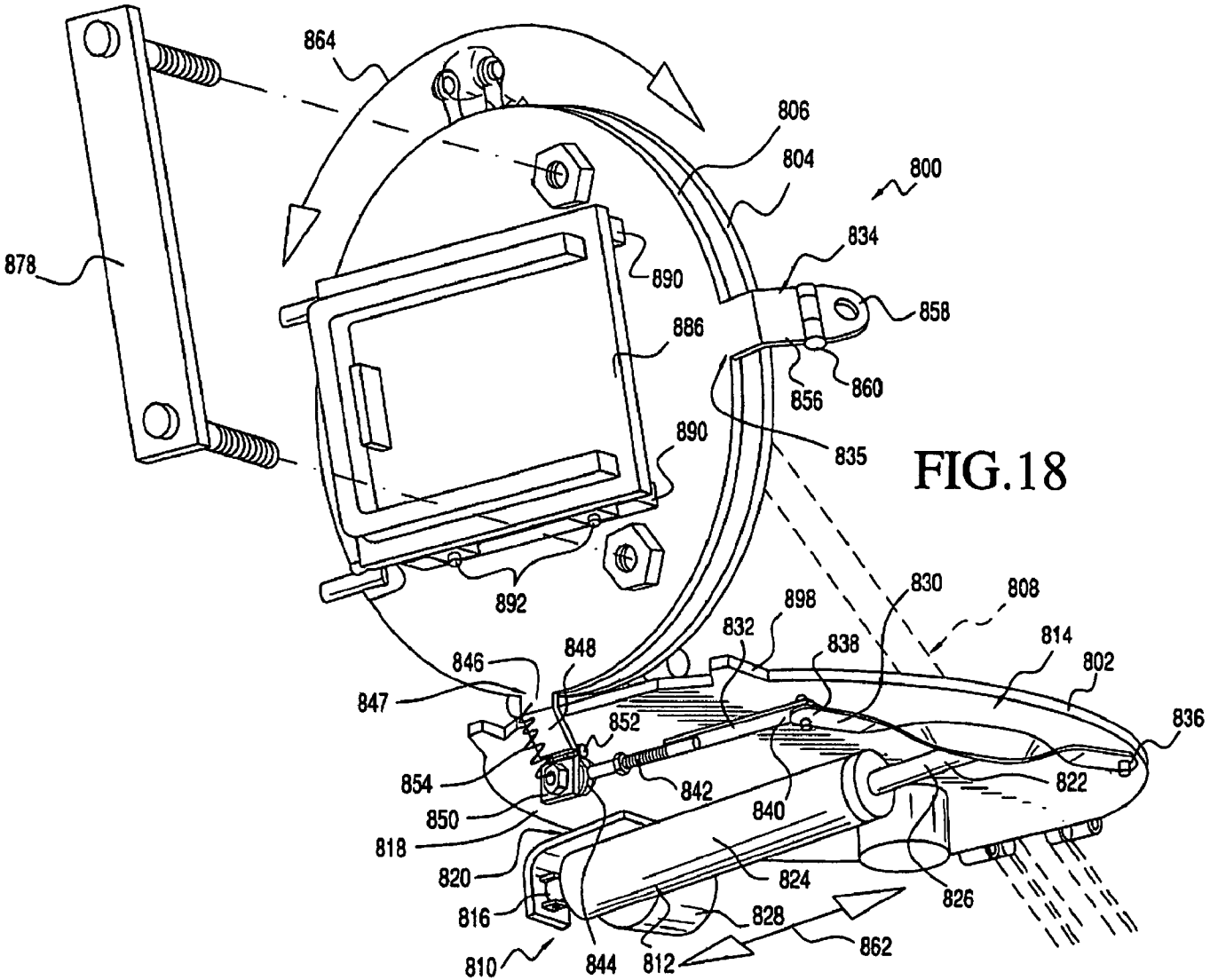
FIG. 18 is an expoloded opposing side perspective view of the ball directing device of FIG. 17, shown in a different operational position; and, FIG. 19 is an exploded side perspective view of an alternative embodiment of a hopper made in accordance with this invention, shown with a ball launching device and the ball directing device of FIG. 17.

FIG. 18 displays a portion of the device 800. The second actuator assembly 810 is disposed adjacent the bottom surface 818 of the support member 802. Preferably, an end of the second actuator assembly is disposed adjacent an outer periphery portion 820 of the support member 802. The second actuator assembly 810 is similar to and operates in a similar fashion to the second actuator assembly 110 described above. For example, the second actuator assembly 810 includes an actuator 812 and linkage 814. Further, the following features are similar to the corresponding features described above for the second actuator assembly 110, namely: a fixed end 816 and an extendable end 822 of the actuator 812; a housing 824; an extendable member 826; a motor 828; a pivot member 830; an intermediate member 832; an attachment member 834; a pivot end 836 and a second end 838 of pivot member; a first end 840 and a second end 842 of the intermediate member 832; and a universal joint 844.

The attachment member 834 is attached to the rotatable member 806. Preferably, the attachment member 834 is attached to a rear periphery portion 835 of the rotatable member 806. The second attachment member 846 is attached to a second periphery portion 847 of the rotatable member 806. The second periphery portion 847 is preferred to be disposed about 90 degrees from the rear periphery portion 835. However, it should be appreciated that in other exemplary embodiments, the second periphery portion 847 is disposed at degrees other than about 90 degrees from the rear periphery portion 835.

The universal joint 844 is selectively and removably attachable to either the attachment member 834 or the second attachment member 846. The selection of which attachment member to be used will depend on the desired use of the user. If the user wants to control the orientation of a ball launching device so as to throw a ball with generally a side spin on the ball, then the attachment member 834 will be utilized and the resulting device will operate similar to the device 10 described above. Otherwise, the second attachment member 846 is chosen to be attached to the universal joint 844 and the resulting device will be similar to the embodiment shown in FIG. 19. By using the second attachment member 846, the ball directing device 800 when used with a ball launching device may for example be effectively used for batting practice.

It will be appreciated that with the universal joint 844 attached to the second attachment member 846, the first actuator assembly 808 will control the angle of the axis of rotation of the ball and the second actuator assembly will control the pitch or attitude of the ball launching device. For example, the first actuator assembly can be actuated so as to raise the tilt member 804 such that the tilt member is substantially perpendicular to the support member 802. With such an arrangement, a ball launching device would throw a ball with substantially no side spin.

Similar to the ball directing device 100 described above, when the universal joint 844 is attached to the first attachment member 834, the second actuator assembly 810 is operably configured such that actuation of the actuator 812 causes panning of the rotatable member 804. The second actuator assembly 810 is adapted to pan the rotatable member 106 through the desired amount of rotation. Preferably, the rotation is through at least 110°.

The attachment member 834 is different than the attachment member 194 described above in the first embodiment. The attachment member 834 in this embodiment includes a bracket member 848, a connecting member 850 and a hinge 852. The bracket member 848 is fixed to the rotatable member 806. The connecting member 850 is attachable to the universal joint 844. The hinge 852 connects the bracket member 848 to the connecting member 850 and allows the connecting member to pivot relative to the bracket member 848. With the attachment member 834 having this configuration, the attachment member 834 will selectively not be stopped by stops 898 on the support member 802, because the connecting member 850 can be tilted up, by the user, as the attachment member 834 rotates past stops 898 when the second actuator assembly 810 is actuated. This is useful for when the second attachment member 846 is utilized.

The second attachment member 846 is similar in design to the attachment member 834. However, it should be appreciated that in other embodiments, the respective attachment members 834 and 846 are not similar. The attachment member 846 includes a bracket member 856, a connecting member 858 and a hinge 860. The bracket member 856 and the connecting member 858 are attached together via the hinge 860, which allows the connecting member 858 to pivot relative to the bracket member 856. The bracket member is fixed to the rotatable member 806. The connecting member is fixable to the swivel joint 844. The hinge 860 and the universal joint 844 provide sufficient degrees of freedom such that the second actuator assembly 810 will be able to operate (i.e. rotate the rotatable member 806) regardless of the amount the first actuator assembly 808 has tilted the tilt member 804 and the rotatable member 806 relative to the support member 802.

The second attachment member 846 also includes a spring 854. One end of the spring 854 is fixed to the bracket member 848 and the other end is connected to the connecting member 850. When the swivel joint 844 is not attached to the second attachment member 846, the spring is biased such that it will pivot the connecting member 850 toward the upper surface of the bracket member 848. In this way, the second attachment member 846 will have a more compact profile when not in use. The more compact profile will prevent the second attachment member 846 from undesirably coming into contact with other elements of the device when the attachment member 834 is being utilized. The spring 854 preferably has enough elasticity to easily allow a user to, when desired, pivot the connecting member 850 so that the second attachment member 846 can be attached to the universal joint 844.

Device 800 also includes a mounting system 866. Mounting system 866 is an alternative embodiment of the mounting bracket 150 discussed above. Mounting system 866 includes a ball launching attachment portion 868 and a hopper attachment portion 870. Both portions 868 and 870 are affixed to the top surface 872 of the rotatable member 806. In this embodiment, the portions 868 and 870 are not connected to one another.

The ball launching attachment portion 868 is similar to the ball launching attachment portion 152 described above and includes a guide 874, a catch member 876, a hold down member 878 and orifices 880 in the hold down member, as well as bolts 882 and receptacles 884. All of these features are similar to the corresponding features discussed above for the ball launching attachment portion 152. Ball launching attachment portion 868 differs from the ball launching portion 152 in several aspects. For example, the guide 874 and the catch member 876 are not directly affixed to the top surface 872 of the rotatable member 806. Rather, the guide 874 and the catch member 876 are affixed to an attachment plate 886. The attachment plate 886 is removably secured to the rotatable member 806.

It will be appreciated that with the attachment plate being removable from the rotatable member 806, additional or other attachment plates may be secured to the rotatable member 806. The additional or other attachment plates will include custom guides and/or other features operably configured to mate with other ball launching devices that have differing frames and require different guides for attachment. With this arrangement, a device made in accordance with the present invention can provide versatility in that a variety of conventional pitching machines can be used with the same ball directing device.

The attachment plate 886 in this exemplary embodiment is removably secured to the rotatable member 806 via brackets 888. Preferably, there are four brackets 888 attached to the attachment plate 886. The brackets 888 are operable configured to align with brackets 890 disposed on the rotatable member 806. Brackets 888 and 890 include orifices that align when the attachment plate 886 is in an attachment position. Bolts 892 extend through the orifices of the brackets 888 and 890 to secure the attachment plate 886 to the rotatable member 806.

The hopper attachment portion 870 includes rods 894. Rods 894 are similar to the rods 168 discussed above. Rods 894 are operably configured to engage support legs of a hopper, as discussed above. Rods 894, in this embodiment are directly affixed to the top surface 872 of the rotatable member 806.

Another difference between the device 800 and the device 10 is the bracket 809, shown in FIG. 19, that provides the pivotal attachment of the actuator 811 of the first actuator assembly 808. With the device 10, this bracket is disposed in substantially the same plane as the tilt member 104, as shown in FIG. 8. However, with the device 800, the bracket 809 is angled downward from the plane of the tilt member 804. The angled relationship between the bracket 809 and tilt member 804 prevents the bracket 809 from inadvertently hitting any other components of the device 800 when in operation.

FIG. 19 displays an exploded of view a hopper 900, a ball directional device 998, and a ball launching assembly 1000. The hopper 900 is an alternative embodiment of a hopper made in accordance with the present invention. The hopper is similar to the hopper 400 described above. The hopper includes a bin 902, a chute 904, an engagement portion 906 and support legs 908 and 910, which have cross support members 944 and 946. The hopper 900 also includes other similar features to the hopper 400, including, among other things, an auger (not shown), a ball flow control device (not shown) and a ball pushing member (not shown). The hopper 900 differs from the hopper 400 with respect to several features.

One difference, for example, is the additional feature of a swivel joint 912. In an actual reduction to practice, the swivel joint 912 is a lazy susan type swivel joint. The swivel joint 912 is disposed between an end 914 of the chute 904 and the engagement portion 906. The swivel joint 912 is operably configured to allow rotational movement of the chute 904 and the bin 902 relative to the engagement portion 906. The relative rotational movement is 0 to 360 degrees. However, it is preferred that the relative rotational movement be at least 180 degrees. With the relative rotational movement, the hopper 900 can be used with either embodiments of the ball directing devices described above, namely devices 100 and 800. More particularly, the relative rotational movement will allow the bin 902 and the chute 904 to be positioned (by rotation) such that the support legs 908 and 910 can engage either the rods 894 on the rotatable member 806, as described above, or rods 930 and 932 on a hopper support bracket, as described below. The latter is employed for the embodiment of the ball directing device 800 when the swivel joint 844 is attached to the second attachment bracket 846, as shown in FIGS. 18–19.

Another difference in this embodiment is the additional feature of the hopper support bracket 916, which has a hanger member 918 and a rod bracket 920. The hanger bracket 918 includes a main body 922 and hangers 924 and 926. The hangers 924 and 926 are attached to the main body 922. The hangers 924 and 926 are adapted to hang on a bolt 1002 of a handle 1004 of the ball launching device 1000. The rod bracket 920 includes a bar 928 that extends from the main body 918. The rod bracket 920 also includes rods 930 and 932, which are disposed on the bar 928. The rods 930 and 932 are operably configured to engage the support legs 908 and 910, respectively.

The hopper 900 also includes a slot 934 and protrusions 936 on an engagement end of the engagement portion 906 as well as a slide prevention bracket 938, all of which are similar to the slot 416, the protrusions 419 and the slide prevention bracket 417, respectively, of the hopper 400. However, the hopper 900 differs from the hopper 400 in that it also includes a second slot 940 and protrusions 942. The second slot 940 and protrusions 942 are provided to help secure the hopper 900 to the feed tube 1008 of the ball launching device 1000. Particularly the screw 1006 tightens down against the slide prevention bracket 938 similar to the previous embodiment. The second slot 940 and protrusions 942 are utilized for the embodiment of the ball directing device 800 when the swivel joint 844 is attached to the second attachment bracket 846, as shown in FIGS. 18–19.

It will be appreciated that it is preferred that in all of the embodiments discussed above the various elements, such as the actuators, motors, solenoids and the like, can be electrically connected via links to a device controller, e.g. controller 500. The links in some embodiments provide power to the elements. In other embodiments, the links provide the controller with control over the operation of the respective elements. In yet other embodiments, the links provide both power and control. It should be appreciated that the links can be any known or later developed device or system connecting the respective elements to the device controller, including a direct cable connection, a radio frequency communication connection, infa-red, etc.

It will be appreciated that any reference above to a bolt or screw, or the like, is not intended to limit the invention to such a particular fastener, unless specifically noted, and that one skilled in the art will recognize that other types of known fasteners can be used for the respective particular applications.

It will be appreciated that the method of the present invention provides for modification of existing pitching machines such that an existing pitching machine can be modified with relative ease to obtain the benefits and features of the automatic ball delivery device according to the present invention.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. An axle housing device for a support stand for an automatic ball throwing machine comprising:

a member;

a support tube disposed on the member and operably configured to receive a support stand leg;

an axle connected to the member and operably configured to receive a wheel; and, a cross support rod affixed to the member opposite and parallel to the axle.

2. An axle housing device, as recited in claim 1, wherein the member has a generally triangular shape.

3. An axle housing device, as recited I claim 1, wherein the cross support rod is removably attached to the member.

4. An axle housing device, as recited in claim 1, wherein the member has a top surface.

5. An axle housing device, as recited in claim 1, wherein the top surface has a threaded orifice.

6. An axle housing device, as recited in claim 5, further comprising a threaded pin operably configured to thread through the threaded orifice of the member and secure the cross support rod to the member.

7. An axle housing device, as recited in claim 1, wherein the support tube rotatably connects the axle housing to the support stand leg.

8. An axle housing device, as recited in claim 1, wherein the support tube is operably configured to insert into the support stand leg.

9. An axle housing device, as recited in claim 1, wherein the axle housing further includes a handle pivotably attached to the member.

10. An axle housing device, as recited in claim 1, wherein two wheels are affixed to the axle.

11. An axle housing device, as recited in claim 1, wherein the axle and the cross support rod are integral.

12. An axle housing system for a support stand for an automatic ball throwing machine comprising:

a first device having a member, a support tube disposed on the member and operably configured to receive a support stand leg, and an axle connected to the member;

a second device identical to the first device; and, a cross support rod having first and second ends, wherein the first end is removably engage with the member of the first device such that the cross support rod is disposed opposite and parallel to the axle of the first device and wherein the second end is removably engaged with the member of the second device such that the cross support rod is disposed opposite and parallel to the axle of the second device.

13. An axle housing system, as recited in claim 12, wherein each support tube is operably configured to insert into the support stand legs.

14. An axle housing system, as recited in claim 12, wherein the axles and the cross support rod are integral.

15. An axle housing system, as recited in claim 12, wherein the cross support rod is removably attached to at least one of the members.

16. An axle housing system, as recited in claim 12, wherein the member of each device further includes a top surface wherein the top surface has a threaded orifice.

17. An axle housing system, as recited in claim 12, wherein the member of each device further comprises a threaded pin operably configured to thread through the threaded orifice of the member and secure the cross support rod to the member.

18. A support stand device for an automatic ball throwing machine, comprising:

a plurality of rear legs attachable to the automatic ball throwing machine;

a front leg opposed to the rear legs and attachable to the automatic ball throwing machine; and, an axle housing device for each of the plurality of rear legs, wherein each axle housing device has a member, a support tube disposed on the member and operably configured to receive a support stand leg, an axle connected to the member and operably configure to receive a wheel, and a cross support rod affixed to the member opposite and parallel to the axle.

19. A support stand device, as recited in claim 18, wherein the axle housing has a generally triangular shape.

20. A support stand device, as recited in claim 18, further comprising a front axle housing device wherein the front axle housing device has a member, a support tube disposed on the member and operably configured to receive the front leg, an axle operably connected to the member and a wheel affixed to the axle.

21. A support stand device, as recited in claim 20, further comprising a handle disposed on the front axle housing.

22. A support stand device, as recited in claim 20, wherein the front axle housing is rotatably attached to the front leg.

23. A support stand device, as recited in claim 20, wherein two wheels are affixed to the front axle housing.

24. A support stand device, as recited in claim 20, wherein the handle is pivotably attached to the front axle housing.

25. An automatic ball throwing device, comprising:

a ball directing assembly having a first member, a second member pivotally attached to the first member, a third member disposed substantially parallel to the second member and rotatably connected to the second member, a first actuator connected to the first and second members, and a second actuator connected to the first and third members;

a ball launching device connected to the third member, wherein orientation of the ball launching device is controlled by actuation of the first and second actuators such that when the first actuator is actuated the second member pivots relative to the first member and when the second actuator is actuated the third member rotates relative to the second member;

a support stand having a plurality of legs, wherein the first member of the ball directing device is attached to the support stand; and, a plurality of axle housing devices affixed to the support stand, wherein each axle housing device has a member, a support tube disposed on the member and operably configured to receive a support stand leg, an axle connected to the member and operably configured to receive a wheel, and a cross support rod affixed to the member opposite and parallel to the axle.

26. A ball throwing device, as recited in claim 25, further comprising a ball hopper attached to the ball launching device and operably configured to deliver balls to the ball launching device.

* * * * *